US009898019B2

(12) United States Patent
Li

(10) Patent No.: US 9,898,019 B2
(45) Date of Patent: Feb. 20, 2018

(54) THYRISTOR ASSISTED ON-LOAD TAP CHANGER AND METHOD THEREOF

(71) Applicant: Xiaoming Li, Jinan (CN)

(72) Inventor: Xiaoming Li, Jinan (CN)

( * ) Notice: Subject to any disclaimer, the term of this patent is extended or adjusted under 35 U.S.C. 154(b) by 120 days.

(21) Appl. No.: 14/439,157

(22) PCT Filed: Dec. 19, 2013

(86) PCT No.: PCT/CN2013/001600

§ 371 (c)(1),
(2) Date: Apr. 28, 2015

(87) PCT Pub. No.: WO2014/101286

PCT Pub. Date: Jul. 3, 2014

(65) Prior Publication Data

US 2015/0293544 A1 Oct. 15, 2015

(30) Foreign Application Priority Data

Dec. 27, 2012 (CN) ..... 2012 1 0579196
Nov. 22, 2013 (CN) ..... 2013 1 0597686

(51) Int. Cl.
*G05F 1/147* (2006.01)
*H01H 9/00* (2006.01)
(Continued)

(52) U.S. Cl.
CPC ..... *G05F 1/147* (2013.01); *H01F 29/04* (2013.01); *H01H 9/0005* (2013.01); *H01H 9/542* (2013.01)

(58) Field of Classification Search
CPC ..... G05F 1/147; H01F 29/04; H01H 9/0005; H01H 9/542
See application file for complete search history.

(56) References Cited

U.S. PATENT DOCUMENTS 3,176,089 A 3/1965 Bleibtreu et al.
4,081,741 A 3/1978 Palmer
(Continued)

FOREIGN PATENT DOCUMENTS

CN 101430966 A 5/2009
CN 102208265 A 10/2011
(Continued)

OTHER PUBLICATIONS

Apr. 3, 2014 International Search Report issued in Chinese Application No. PCT/CN2013/001600.
(Continued)

*Primary Examiner* — Gustavo Rosario Benitez
*Assistant Examiner* — Demetries A Gibson
(74) *Attorney, Agent, or Firm* — Oliff PLC

(57) ABSTRACT

A terminal I thereof is respectively connected with transition switches, and a terminal II is respectively connected with transition switches; the other terminals of the transition switches are jointly connected and are connected with the terminal through a saturable reactor and a thyristor switch; the other terminals of the transition switches are jointly connected and are connected with the terminal through a linear reactor, a saturable reactor and an overvoltage triggering thyristor circuit; an odd-numbered side main contact is respectively connected with the terminal I and a common terminal, and an even-numbered side main contact is respectively connected with the terminal II and the common terminal; the terminals of non-common terminals of a main path and a transition path are further connected with a bidirectional voltage stabilizing circuit.

6 Claims, 6 Drawing Sheets

(51) Int. Cl.
*H01F 29/04* (2006.01)
*H01H 9/54* (2006.01)

(56) References Cited

U.S. PATENT DOCUMENTS 4,520,246 A 5/1985 Yoshii et al.
4,622,513 A 11/1986 Stich
5,128,605 A 7/1992 Dohnal et al.
5,604,423 A * 2/1997 Degeneff ..... G05F 1/20 323/258
5,694,034 A * 12/1997 Dohnal ..... H01F 29/04 200/11 TC
7,595,614 B2 9/2009 Stich et al.
7,880,341 B2 2/2011 Shin
2006/0039171 A1* 2/2006 Lavieville ..... H01F 29/04 363/19
2008/0061715 A1* 3/2008 Yang ..... H05B 41/282 315/307
2009/0140705 A1* 6/2009 Dohnal ..... G05F 1/20 323/258
2009/0146637 A1* 6/2009 Stich ..... H01H 9/0005 323/343
2009/0230933 A1* 9/2009 Oates ..... G05F 1/14 323/258
2012/0013271 A1* 1/2012 Lei ..... H02M 3/1584 315/308
2012/0025789 A1* 2/2012 Brueckl ..... H01H 9/0005 323/258
2012/0306471 A1* 12/2012 Green ..... H01H 9/542 323/355
2014/0375407 A1* 12/2014 Von Bloh ..... H01F 29/04 336/150

FOREIGN PATENT DOCUMENTS

CN 102779667 A 11/2012
CN 103019284 A 4/2013

OTHER PUBLICATIONS

Apr. 3, 2014 Written Opinion issued in International Application No. PCT/CN2013/001600.

* cited by examiner

THYRISTOR ASSISTED ON-LOAD TAP CHANGER AND METHOD THEREOF

FIELD OF THE INVENTION

The present invention relates to the technical field of power transmission and transformation of power systems, and particularly relates to a thyristor assisted on-load tap changer and a method thereof.

BACKGROUND OF THE INVENTION

The operation mode of a power system changes at any time, and the change of the operation mode will cause the fluctuation of a bus voltage. The power system has strict requirements on the fluctuation range of the bus voltage, therefore, a technology for regulating the bus voltage is needed. The most direct manner of regulating the voltage is to change a transformer tap. However, in a load transmission process of the power system, an on-load tap changer with a very high technical content is required for changing the transformer tap without power outage. Reactive on-load tap changers and resistive on-load tap changers are mainly adopted in the world at present. U.S. Pat. No. 3,176,089, U.S. Pat. No. 5,128,605 and U.S. Pat. No. 7,880,341 disclose the reactive on-load tap changers, and U.S. Pat. No. 4,081,741 and U.S. Pat. No. 4,520,246 disclose the resistive on-load tap changers. The reactors of the reactive on-load tap changers are energized for a long term, are relatively large in volumes and are only adopted in the America in the world, and the resistive on-load tap changers are generally adopted in other countries. The resistive on-load tap changers suffer a heating problem, and a significant rise in temperature will be generated by switching the taps of the on-load tap changers for multiple times within a short period of time. Therefore, the switching time of the on-load tap changers within a certain time is strictly limited.

The performance of the on-load tap changer is improved by a thyristor circuit in the U.S. Pat. No. 4,622,513. One of the invention points is that when the switch of a switched current path is switched off, an overvoltage triggering thyristor circuit of a switching path is automatically switched on to quickly splice and switch load current. The defect of the overvoltage triggering thyristor circuit lies in that very large pulse interference is generated every 10 milliseconds. Therefore, adequate anti-interference measures and safety measures are needed to ensure the reliable work of the on-load tap changer. Another invention point of the invention is that, a bidirectional parallel thyristor is triggered by a current transducer to assist a mechanical switch to disconduct the switched current path; the bidirectional parallel thyristor is connected with the mechanical switch in parallel, and the bidirectional parallel thyristor may be switched on by the pulse interference by mistake to cause short circuit circulation. Therefore, the overvoltage triggering thyristor circuit in the invention is serially connected with a transition resistor, in order to limit the possible short circuit circulation to improve the operation safety of the thyristor; thus in U.S. Pat. No. 4,622,513, the heating of the transition resistor is only reduced, while the heating problem of the transition resistor is not solved completely. The U.S. Pat. No. 7,595,614 is an improvement of U.S. Pat. No. 4,622,513. In the U.S. Pat. No. 7,595,614, the transition resistor serially connected with the overvoltage triggering thyristor circuit is cancelled, the heating problem of the transition resistor is solved; since the transition resistor limiting the short circuit circulation is cancelled, in the case of the short circuit circulation, the short circuit circulation is very large; in U.S. Pat. No. 7,595,614, protection is only achieved by a fuse, and the reaction speed of fuse protection is slow, so the safety is poor. In the U.S. Pat. No. 7,595,614, the bidirectional parallel thyristor is still triggered by the current transducer to disconduct the switched current path, and no new anti-interference measure is added, thus the reliability is poor.

In the U.S. Pat. No. 4,622,513 and U.S. Pat. No. 7,595,614, a bidirectional parallel thyristor switching circuit is triggered by the secondary current of a current transducer to switch on and cut off a bidirectional parallel thyristor, and the reliability of a trigger circuit is poor. In the U.S. Pat. No. 4,622,513 and U.S. Pat. No. 7,595,614, a traditional complicated mechanical cam sliding mechanism and an energy accumulating mechanism are stilled adopted, thus the operation vibration and the noise are large; failure is liable to happen, and more frequent operation cannot be implemented.

SUMMARY OF THE INVENTION

The purpose of the present invention is to solve the above problems, (1) to overcome the shortcomings and to provide an overvoltage triggering thyristor circuit assisted on-load tap changer, which has no transition resistor, has a short circuit circulation limit measure and is high in safety and high in reliability; (2) to give play to the advantages and to provide an on-load tap changer, which needs no constraint of a mechanical linkage between a tap selector and a switcher and is clear in logical relationship, simple in structure and convenient to cooperate; (3) to provide an on-load tap changer, which is simpler in structure and is more economical.

To achieve the above purpose, the present invention adopts the following technical solutions:

a thyristor assisted on-load tap changer, including:

a thyristor assisted on-load tap changer includes a main path and a transition path; the main path is composed of a switch K1, and the transition path is composed of a linear reactor L1, a saturable reactor L2 and an overvoltage triggering thyristor circuit, which are connected in series; one end of the switch K1 is switched between a tap selector terminal I and a tap selector terminal II through a change-over switch K5, and one end of the linear reactor L1 is switched between the tap selector terminal I and the tap selector terminal II through a change-over switch K6; the switch K1 and the other end of the overvoltage triggering thyristor circuit are connected with a common terminal.

A thyristor assisted on-load tap changer includes a main path and a transition path; the main path is composed of a saturable reactor L4 and a thyristor switch controlled by a control switch K10, which are connected in series; the transition path is composed of a linear reactor L1, a saturable reactor L2 and an overvoltage triggering thyristor circuit, which are connected in series; one end of the saturable reactor L4 is switched between a tap selector terminal I and a tap selector terminal II through a change-over switch K5, and one end of the linear reactor L1 is switched between the tap selector terminal I and the tap selector terminal II through a change-over switch K6; the thyristor switch and the other end of the overvoltage triggering thyristor circuit are connected with a common terminal.

A thyristor assisted on-load tap changer includes a main path and a transition path; the main path is composed of a saturable reactor L4 and a thyristor switch controlled by a control switch K10, which are connected in series; the transition path is composed of a linear reactor L1, a saturable reactor L2 and an overvoltage triggering thyristor circuit, which are connected in series; one end of the saturable reactor L4 is jointly connected with one ends of transition switches K15, K14, and the other ends of the transition switches K15, K14 are respectively connected with tap selector terminals I, II; one end of the linear reactor L1 is jointly connected with one ends of transition switches K17, K16, and the other ends of the transition switches K17, K16 are respectively connected with the tap selector terminals I, II; the thyristor switch and the other end of the overvoltage triggering thyristor circuit are connected with a common terminal; an odd-numbered side main contact K11 is further connected between the tap selector terminal I and the common terminal, and an even-numbered side main contact K12 is further connected between the tap selector terminal II and the common terminal.

The reactance of the linear reactor L1 is larger than zero and is smaller than $Z_1$; $Z_1$ is equal to a quotient obtained by dividing a rated voltage between the tap selector terminals I, II by rated load current.

The linear reactor L1 and the saturable reactor L2 are merged into a reactor L3; the reactor L3 is provided with a magnetic flux closed-loop iron core and a coil L3, a part of section of the magnetic flux closed-loop iron core has a larger sectional area, and the sectional area of the rest section of the iron core is smaller; the coil L3 is winded on the iron core at the section with the larger sectional area; when the current is relatively small, the closed-loop iron core is unsaturated; the coil L3 is equivalent to the saturable reactor L2; when the current is relatively large, the iron core at the section with the smaller sectional area of the closed-loop iron core is saturated, and the iron core at the section with the larger sectional area is unsaturated; the reactance of the coil L3 is decreased to a smaller value quickly, and at this time, the coil L3 is equivalent to the linear reactor L1.

The overvoltage triggering thyristor circuit includes a fuse FU1, and the fuse FU1 is serially connected with a pair of thyristors D1, D2 reversely connected in parallel to form a main path of the overvoltage triggering thyristor circuit; a resistor R1 and a capacitor C1 are connected to the two ends of the thyristors D1, D2 reversely connected in parallel after being connected in series; the gate electrodes and the cathodes of the two thyristors D1, D2 are respectively connected with capacitors C2, C3, resistors R2, R3 and diodes D3, D4; the gate electrodes of the two thyristors D1, D2 are further respectively connected with the input terminal of a full-bridge rectifier composed of diodes D5, D6, D7, D8, the output end of the full-bridge rectifier is connected with a constant voltage diode D9, the cathode of the constant voltage diode D9 is connected with the output end anode of the full-bridge rectifier, and the anode of the constant voltage diode D9 is connected with the output end cathode of the full-bridge rectifier; the stabilized voltage $U_1$ of the constant voltage diode D9 is equal to $k_1U_2$; $k_1$ refers to a confidence coefficient and is a value of 1.2-2; $U_2$ refers to the peak value of a rated working frequency operating voltage connected between the tap selector terminals I, II of the on-load tap changer.

The thyristor switch includes: a fuse FU1 is serially connected with a pair of thyristors D1, D2 reversely connected in parallel to form a main path of the thyristor switch; a resistor R1 and a capacitor C1 are connected to the two ends of the thyristors D1, D2 reversely connected in parallel after being connected in series; the gate electrodes and the cathodes of the two thyristors D1, D2 are respectively connected with capacitors C2, C3, resistors R2, R3 and diodes D3, D4; the gate electrodes of the two thyristors D1, D2 are further respectively connected with the input terminal of a full-bridge rectifier composed of diodes D5, D6, D7, D8; a constant voltage diode D11 and a constant voltage diode D9 are serially connected in the same direction, the serial anodes of the constant voltage diodes D11, D9 are connected with the cathode of the full-bridge rectifier, and the serial cathodes of the constant voltage diodes D11, D9 are connected with the anode of the full-bridge rectifier; the anode of a diode D10 is connected with the anode of the full-bridge rectifier, the cathode of the diode D10 is connected with one end of a switch K10, and the other end of the switch K10 is connected with the cathode of the full-bridge rectifier; the stabilized voltage value $U_3$ of the serially connected constant voltage diode D11 and constant voltage diode D9 is equal to $k_2(U_1+U_2)$; $k_2$ refers to a confidence coefficient and is a value of 1.1-1.5; $U_1=k_1U_2$, $k_1$ refers to a confidence coefficient and is a value of 1.2-2; $U_2$ refers to the peak value of a rated working frequency operating voltage connected between the tap selector terminals 1, 2 of the on-load tap changer; the sum of positive tube voltage drops of all semiconductors of a gate electrode trigger loop of the thyristor D1 or D2 is about $1.5U_4$, $U_4$ refers to the maximum current and includes the transient peak value of the short circuit current possibly flowing by and the positive tube voltage drop flowing by the main path of the thyristor D1 or D2.

The terminal of a non-common terminal of the main path and the terminal of a non-common terminal of the transition path are further connected with a bidirectional voltage stabilizing circuit; the voltage stabilizing value of the bidirectional voltage stabilizing circuit is larger than the peak value $U_2$ of the rated working frequency operating voltage connected between the tap selector terminals I, II of the on-load tap changer and is smaller than the stabilized voltage $U_1$ of the constant voltage diode D9.

The switches (contacts) are contactors with locks and are composed of closing coils, breaking coils, main contacts and auxiliary contacts; or are contactors without locks and are composed of closing coils, main contacts and auxiliary contacts; the coils are energized or de-energized to switch on and switch off the switches (contacts).

A thyristor assisted on-load tap changer is composed of a tap selector and a switcher; the tap selector is connected with the switcher, and after the tap selector selects the tap of a regulating transformer, the switcher achieves the on-load switch of the tap; wherein the switcher includes a main switch K21-1, a main switch K22-1, an economical thyristor assisted circuit I, an economical thyristor assisted circuit II, a piezoresistor R and three terminals J1, J2, J3;

one end of the main switch K21-1 is connected with the terminal J1, and the other end of the main switch K21-1 is connected with the terminal J3; the economical thyristor assisted circuit I is connected with the main switch K21-1 in parallel;

one end of the main switch K22-1 is connected with the terminal J2, and the other end of the main switch K22-1 is connected with the terminal J3; the economical thyristor assisted circuit II is connected with the main switch K22-1 in parallel;

the end of the economical thyristor assisted circuit I close to the J1 and the end of the thyristor assisted circuit II close to the J2 are further connected with the piezoresistor R;

a pair of switches are respectively arranged in the economical thyristor assisted circuit I and the economical thyristor assisted circuit II, for controlling the state switch of the corresponding thyristor assisted circuit, wherein the serial number of a normally open switch KA in the economical thyristor assisted circuit I is K23-1, and the serial number of KB is K25-1;

the serial number of a normally open switch KA in the economical thyristor assisted circuit II is K24-1, and the serial number of KB is K26-1.

A thyristor assisted on-load tap changer is composed of a tap selector and a switcher; the tap selector is connected with the switcher, and after the tap selector selects the tap of a regulating transformer, the switcher achieves the on-load switch of the tap; wherein the switcher includes a main switch K21-1, a main switch K22-1, a switch K27-1, a switch K28-1, an economical thyristor assisted circuit I, an economical thyristor assisted circuit II, a piezoresistor R and three terminals J1, J2, J3;

one end of the main switch K21-1 is connected with the terminal J1, and the other end of the main switch K21-1 is connected with the terminal J3; one end of the economical thyristor assisted circuit I is connected with the terminal J3, and the other end of the economical thyristor assisted circuit I is connected with the terminal J1 through the switch K27-1;

one end of the main switch K22-1 is connected with the terminal J2, and the other end of the main switch K22-1 is connected with the terminal J3; one end of the economical thyristor assisted circuit II is connected with the terminal J3, and the other end of the economical thyristor assisted circuit II is connected with the terminal J2 through the switch K28-1;

the end of the economical thyristor assisted circuit I connected with the switch K27-1 and the end of the thyristor assisted circuit II connected with the switch K28-1 are further connected with the piezoresistor R;

a pair of switches are respectively arranged in the economical thyristor assisted circuit I and the economical thyristor assisted circuit II, for controlling the state switch of the corresponding thyristor assisted circuit, wherein the serial number of a normally open switch KA in the economical thyristor assisted circuit I is K23-1, and the serial number of KB is K25-1;

the serial number of a normally open switch KA in the economical thyristor assisted circuit II is K24-1, and the serial number of KB is K26-1.

The economical thyristor assisted circuit I and the economical thyristor assisted circuit II have the same structure and respectively include:

a pair of thyristors D1, D2 are reversely connected in parallel to form a main path of the thyristor assisted circuit;

a resistor R1 and a capacitor C1 are connected to the two ends of the thyristors D1, D2 reversely connected in parallel after being connected in series;

the gate electrodes and the cathodes of the two thyristors D1, D2 are respectively connected with capacitors C2, C3, resistors R2, R3 and diodes D3, D4; the anodes of the diodes D3, D4 are respectively connected with the gate electrodes of the thyristors D1, D2, and the cathodes of the diodes D3, D4 are respectively connected with the cathodes of the thyristors D1, D2;

the input terminal of a full-bridge rectifier composed of diodes D5, D6, D7, D8 is connected between the gate electrodes of the two thyristors D1, D2 after being serially connected with a normally open switch KB, the output end of the full-bridge rectifier is connected with a constant voltage diode D9, the cathode of the constant voltage diode D9 is connected with the anode output end of the full-bridge rectifier, and the anode of the constant voltage diode D9 is connected with the cathode output end of the full-bridge rectifier;

diodes D13, D14, D15 are serially connected in the same direction, diodes D16, D17, D18 are serially connected in the same direction, and the two diode strings are serially connected with a normally open switch KA after being reversely connected in parallel and are connected between the gate electrodes of the two thyristors D1, D2.

In the tap terminals of the regulating transformer, the centremost terminal is defined as a null line, the null line and an adjacent tap terminal of the regulating transformer are respectively connected with two terminals of a primary coil of a transformer T2, and the terminal of a secondary coil of the transformer T2 provides an AC control voltage to the switcher; one terminal of the AC control voltage is defined as a null line, and the null line of the primary coil of the transformer T2 is connected with the null line of the secondary coil of the transformer T2;

the AC control voltage terminal is further used as the input to a DC voltage stabilization power supply module, the DC voltage stabilization power supply module provides a DC control voltage to the switcher, the low-potential terminal of the DC control voltage is defined as a null line, and the null line of the DC control voltage is connected with the null line of the AC control voltage.

The working method of the thyristor assisted on-load tap changer is characterized in that, a. the working method of switching the conduction of the terminal J1 of the switcher with the common terminal J3 to the conduction of the terminal J2 with the common terminal J3 is as follows:

(1) switching on the switch K23-1 and switching on the switch K26-1; (2) switching off the main switch K21-1; (3) switching off the switch K23-1; (4) switching on the switch K24-1; (5) switching on the main switch K22-1; (6) resetting the entire group;

b. the working method of switching the conduction of the terminal J2 of the switcher of the on-load tap changer with the common terminal J3 to the conduction of the terminal J1 with the common terminal J3 is as follows:

(1) switching on the switch K24-1 and switching on the switch K25-1; (2) switching off the main switch K22-1; (3) switching off the switch K24-1; (4) switching on the switch K23-1; (5) switching on the main switch K21-1; (6) resetting the entire group. When switching the conduction of the terminal J1 of the switcher of the on-load tap changer with the common terminal J3 to the conduction of the terminal J2 with the common terminal J3, the time interval between switching off the switch K23-1 and switching on the switch K24-1 is larger than 20 milliseconds;

when switching the conduction of the terminal J2 of the switcher of the on-load tap changer with the common terminal J3 to the conduction of the terminal J1 with the common terminal J3, the time interval between switching off the switch K24-1 and switching on the switch K23-1 is larger than 20 milliseconds.

The beneficial effects of the present invention lie in that: the transition resistor is cancelled and the heating problem of the resistor is solved; measures for limiting the short circuit circulation can be adopted on occasions with high safety requirements to better ensure the safety of the overvoltage triggering thyristor circuit and the transistor switch circuit. The overvoltage triggering thyristor circuit and the transistor switch circuit have stronger anti-interference measures to ensure the reliable work of the thyristor assisted on-load tap changer under a strong pulse interference condition. No current is generated in the disconduction and conduction processes of the mechanical switch; arc-free switch is achieved; and the switch contact is not damaged by frequent action. The energy accumulating mechanism of the traditional on-load tap changer can be eliminated, thus the overall action time of the thyristor assisted on-load tap changer can be shortened. The complicated mechanical linkage mechanism, particularly the energy accumulating mechanism is removed to reduce the volume and weight of the on-load tap changer; the failure rate is decreased. The control circuit in the manner of an intermediate relay (contactor) can be adopted to ensure entering the action program of the next switch after the action of a certain switch is finished, in order to improve the reliability. The action of the tap selector needs no intervention of the switcher, the switcher is started to work after the action of the tap selector is finished, and no intervention of the tap selector is needed in the switch process of the switcher; the tap selector and the switcher need no constraint of a mechanical linkage, and are clear in logical relationship, simple in structure and convenient to cooperate.

For the thyristor assisted on-load tap changer, the electric switches can be manually operated to sequentially act to achieve the on-load switch of the switcher; the electric switches can be driven by a mechanical linkage mechanism to sequentially act to achieve the on-load switch of the switcher; the electric switches can be controlled by the contacts of contactors (relays) to sequentially act to achieve the on-load switch of the switcher; a variety of methods can be adopted, thus the application is flexible. The action state of the main contact is reflected by the auxiliary contact of the relay (contactor), namely, it is ensured that the action program of the next switch is entered after the action state of a certain switch is determined and that the action program of the next switch is entered immediately after the action state of the certain switch is determined; a perfect combination of speed and reliability is achieved. Except the main switch, a switcher of the thyristor assisted on-load tap changer needs no other large capacity relay (contactor); the thyristor trigger circuit can be controlled by the on/off of the contact of a small capacity relay (contactor) to switch on/off a high current thyristor, in order to switch the on-load tap changer. The on-load tap changer is simple in structure, convenient to control and low in cost. The main switch and the contact of the small capacity relay (contactor) are operated in an arc-free manner. Within the non-action time period of the on-load tap changer, the thyristor assisted circuit has no voltage, thus the safety of the thyristor assisted circuit is high. The voltage difference between the control power supply potential and the switch contact of the switcher of the thyristor assisted on-load tap changer is small, and the requirements on the withstand voltage of the insulating material there between are low; particularly for the on-load tap changer of a 10 kV system, the on-load tap changer in the present invention can be manufactured by a conventional AC contactor to reduce the manufacturing cost.

Wherein, 1. tap selector terminal I, 2. tap selector terminal II, 3. common terminal, 4. overvoltage triggering thyristor circuit, 5. reactor iron core, 6. thyristor switch, 7. bidirectional voltage stabilizing circuit, 8. economical thyristor assisted circuit I, 9. economical thyristor assisted circuit II, 10. tap selector, 11. Switcher (diverter switch), 12. DC voltage stabilization power supply module.

EMBODIMENT 1

A further illustration of the present invention will be given below in combination with accompanying drawings and embodiments.

Figure 1:
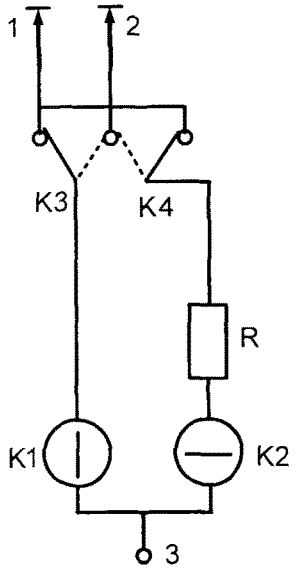
FIG. 1 shows a structure and a connecting manner of an existing on-load tap changer.

FIG. 1 shows a working principle structure and a connecting manner of an existing on-load tap changer. The on-load tap changer is composed of a tap selector and a switcher. The tap selector is connected with the switcher, and after the tap selector selects the tap of a regulating transformer, the switcher achieves the on-load switch of the tap. The working principle of the tap selector of the on-load tap changer is public knowledge; the on-load tap changer is characterized by the switcher, and the so-called on-load tap changer generally refers to the switcher (diverter switch) of the on-load tap changer.

Figure 2:
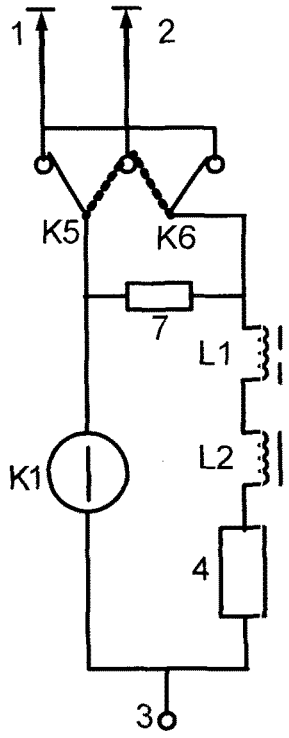
FIG. 2 shows a structure and a connecting manner of a thyristor assisted on-load tap changer.

The principle structure and the connecting manner of a thyristor assisted on-load tap changer in the present invention are as shown in FIG. 2. It includes two tap selector terminals I1,II2, a common terminal 3, two change-over switches K5, K6, a main vacuum switch K1, an overvoltage triggering thyristor circuit 4, a linear reactor L1, a saturable reactor L2 and a bidirectional voltage stabilizing circuit 7; one tap terminal of the change-over switch K5 and one tap terminal of the change-over switch K6 are jointly connected with the tap selector terminal I1, the other tap terminal of the change-over switch K5 and the other tap terminal of the change-over switch K6 are jointly connected with the tap selector terminal II2; the common terminal of the change-over switch K5 is connected with the common terminal 3 of the on-load tap changer through the main vacuum switch K1 to form a main path; the common terminal of the change-over switch K6 is serially connected with the common terminal 3 of the on-load tap changer through the linear reactor L1, the saturable reactor L2 and the overvoltage triggering thyristor circuit 4 to form a transition path; the bidirectional voltage stabilizing circuit 7 is connected between the common terminal of the change-over switch K5 and the common terminal of the change-over switch K6.

Figure 3:
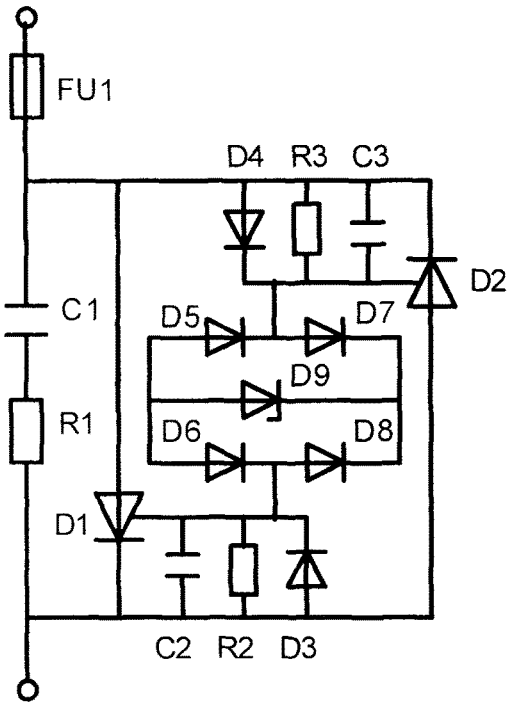
FIG. 3 shows an overvoltage triggering thyristor circuit.

The overvoltage triggering thyristor circuit 4 is as shown in FIG. 3. A fuse FU1 is serially connected with a pair of thyristors D1, D2 reversely connected in parallel to form a main path. A resistor R1 and a capacitor C1 are connected to the two ends of the thyristors D1, D2 reversely connected in parallel after being connected in series, in order to achieve the oscillation damping in the processes which the thyristors D1,D2 are triggered on/off and prevent the wrong trigger caused by the over fast voltage rise at the two ends of the thyristors D1, D2. The gate electrodes and the cathodes of the two thyristors D1, D2 are respectively connected with capacitors C2, C3 and resistors R2, R3 for resisting interference; the anodes of diodes D3, D4 are respectively connected with the cathodes of the thyristors, and the cathodes of the diodes are respectively connected with the gate electrodes of the thyristors to protect the gate electrodes and the cathodes from being broken down by a reverse voltage and to provide a reverse current path. The gate electrodes of the two thyristors D1, D2 are further respectively connected with the input terminal of a full-bride rectifier composed of diodes D5, D6, D7, D8, the output end of the full-bride rectifier is connected with a constant voltage diode D9, the cathode of the constant voltage diode D9 is connected with the output end anode of the full-bride rectifier, the anode of the constant voltage diode D9 is connected with the output end cathode of the full bridge rectifier circuit, and multiple low voltage level constant voltage diode D9 can be serially connected to obtain a high voltage level constant voltage diode.

The stabilized voltage of the constant voltage diode D9 should be larger than the peak value of the maximal normal voltage between the tap selector terminals I1, II2, in order to ensure that the constant voltage diode D9 is not conducted when performing on-load voltage regulation on the voltage of the regulating transformer within the maximal normal fluctuation range. If the stabilized voltage of the constant voltage diode D9 is too large, the withstand voltage of the main vacuum switch K1 is required to be increased and the withstand voltages of the thyristors D1, D2 are required to be increased, thus increasing the volume and investment of the on-load tap changer. If the stabilized voltage of the constant voltage diode D9 is too large, the interference of the overvoltage triggering thyristor circuit 4 with other equipment is increased, and the reliability of the thyristor assisted on-load tap changer is poor. In particular, if the stabilized voltage of the constant voltage diode D9 is too large, the interference of the overvoltage triggering thyristor circuit 4 will produce a transient DC component to excite the regulating transformer to produce magnetizing rush current to cause protection trip. The stabilized voltage of the constant voltage diode D9 cannot be too large to ensure the reliable operation of the thyristor assisted on-load tap changer. Therefore, the stabilized voltage $U_1$ of the constant voltage diode D9 is equal to $k_1U_2$; $k_1$ refers to a confidence coefficient and is a value of 1.2-2; $U_2$ refers to the peak value of a rated working frequency operating voltage connected between the tap selector terminals 1, 2 of the on-load tap changer. It is recommended that $k_1$ is 1.5.

The conduction of the tap selector terminal I1 of the thyristor assisted on-load tap changer with the common terminal 3 can be switched to the conduction of the tap selector terminal II2 with the common terminal 3; the conduction of the tap selector terminal II2 with the common terminal 3 can be switched to the conduction of the tap selector terminal I1 with the common terminal 3.

The working principle of switching the conduction of the tap selector terminal I1 of the on-load tap changer with the common terminal 3 to the conduction of the tap selector terminal II2 with the common terminal 3 is as follows:

(1) the change-over switch K6 is switched; the overvoltage triggering thyristor circuit 4 is switched on, since the stabilized voltage of the constant voltage diode D9 is larger than the peak value of the maximal normal AC voltage between the tap selector terminals I1, II2, the constant voltage diode D9 is not conducted, and the thyristors D1, D2 reversely connected in parallel are not triggered; the overvoltage triggering thyristor circuit 4 is not conducted;

(2) the main vacuum switch K1 is switched off; the main path is switched off, and the potential of the terminal 3 connected with a load quickly decreases; the voltages at the two ends of the overvoltage triggering thyristor circuit 4 quickly rise, when the instantaneous value of the voltage is larger than the stabilized voltage of the constant voltage diode D9, the constant voltage diode D9 is conducted to trigger the thyristor D1 or D2 to be conducted, and the transition path is automatically switched on; load current flows in from the tap selector terminal II2 and flows out from the common terminal 3 through the transition path; since the current is alternating current, the overvoltage triggering thyristor circuit 4 automatically cuts off the current loop for one time at a zero crossing point of the current; then, the voltages at the two ends of the overvoltage triggering thyristor circuit 4 rise again, and the overvoltage triggering thyristor circuit 4 is conducted again; the voltages at two ends of the overvoltage triggering thyristor circuit 4 are pulse voltages performing positive and negative transformation every 10 milliseconds; the pulse peak value is equal to the stabilized voltage of the constant voltage diode D9. The positive and negative alternating pulse voltage has small influence on the waveform of the load current and has small influence on the waveform of the load voltage; the load current is transferred from the main path to the transition path;

(3) the change-over switch K5 is switched;

(4) the main vacuum switch K1 is switched on; the load current flows through the main vacuum switch K1, and the current of the overvoltage triggering thyristor circuit 4 is reduced to zero.

When the main vacuum switch K1 is not switched off, the overvoltage triggering thyristor circuit 4 will form short circuit circulation due to interference and wrong conduction. For a large capacity power system, if the reactance of the linear reactor L1 is equal to zero, very large short circuit circulation will be formed. At this time, as long as the reactance of the linear reactor L1 is slightly larger than zero, the effect of limiting the short circuit current is very obvious. Therefore, for the safety of the thyristor assisted on-load tap changer, the reactance of the linear reactor L1 must be larger than zero. If the reactance of the linear reactor L1 is large, the advantages lie in that the formed short circuit circulation is small and the safety is good. The defects lie in that the linear reactor L1 may generate larger interference, in particular the DC component excite an iron core transformer to produce magnetizing rush current, thus the harm is quite large. The value of the linear reactor L1 is designed to balance the conflict of limiting the short circuit circulation and reducing the interference. Considering that the overvoltage triggering thyristor circuit can limit the short circuit circulation time within a half cycle, as long as the short circuit circulation is not larger than 10 times of rated working current of the thyristor, the safety of the thyristor is guaranteed; the reactance of the linear reactor L1 should be larger than zero and smaller than $Z_1$; $Z_1$ is equal to a quotient obtained by dividing a rated voltage between the tap selector terminals 1, 2 by rated load current. It is recommended that the reactance of the linear reactor L1 is about 0.1 $Z_1$. In order to reduce the volume, it is recommended that the reactor L1 is a reactor provided with an air gap iron core.

The fuse FU1 can cut off the short circuit circulation to serve as the backup protection of the thyristor D1 (D2).

One function of the saturable reactor L2 is to reduce the rate of rise of the current at the conducting moment of the thyristor D1 (D2). The other function of the saturable reactor L2 is as follows: the saturable reactor L2 cooperates with the resistor R1 and the capacitor C1 in the overvoltage triggering thyristor circuit 4 to improve the anti-interference capability of the overvoltage triggering thyristor circuit 4. The narrow voltage pulse interference resistance of the saturable reactor is larger than that of the linear reactor.

The function of the bidirectional voltage stabilizing circuit 7 is to ensure that the voltages at the two ends of the bidirectional voltage stabilizing circuit 7 do not exceed a voltage stabilizing value, the voltage stabilizing value of the bidirectional voltage stabilizing circuit 7 is smaller than $U_2$ and is smaller than the stabilized voltage $U_1$ of the constant voltage diode D9. When the voltage between the tap selector terminals I1, II2 is a normal rated voltage, the bidirectional voltage stabilizing circuit 7 is not conducted; in the case of a higher interference pulse voltage between the tap selector terminals I1, II2, the interference pulse is clipped to ensure that the interference pulse voltage is not larger than the stabilized voltage $U_1$ of the constant voltage diode D9 in the overvoltage triggering thyristor circuit 4, in order to prevent the interference pulse between the tap selector terminals I1, II2 form triggering the conduction of the overvoltage triggering thyristor circuit 4 to generate the short circuit circulation. If other circuits can eliminate the interference pulse between the tap selector terminals I1, II2, the bidirectional voltage stabilizing circuit 7 can be removed. The bidirectional voltage stabilizing circuit 7 can be achieved by a piezoresistor and can also be achieved by a pair of high power constant voltage diodes which are reversely connected in series.

Figure 4:
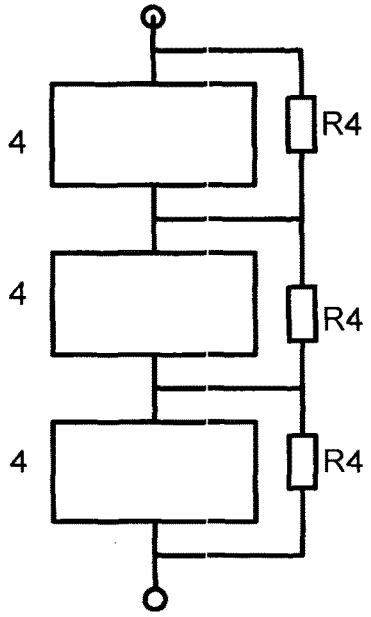
FIG. 4 shows serial connection of overvoltage triggering thyristor circuits.

When the thyristor assisted on-load tap changer is applied to an extra-high voltage level, the withstand voltages of the existing thyristors D1, D2 are inadequate. Multiple overvoltage triggering thyristor circuits 4 can be serially connected to improve the working voltage. FIG. 4 shows serial connection of three stages of overvoltage triggering thyristor circuits. R4 refers to a divider resistor; when multiple overvoltage triggering thyristor circuits are serially connected, the R4 balances the voltages of the overvoltage triggering thyristor circuits.

Figure 5:
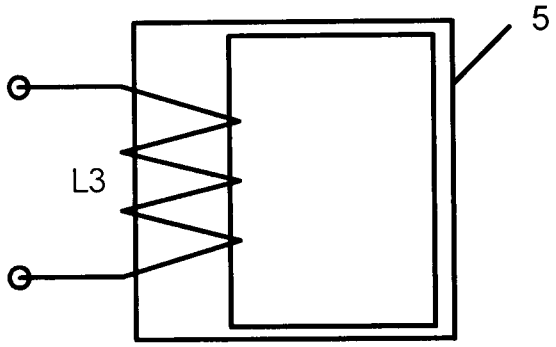
FIG. 5 shows a reactor structure.

The thyristor assisted on-load tap changer of FIG. 2 is provided with a linear reactor L1 and a saturable reactor L2. To further simplify the structure, the linear reactor L1 and the saturable reactor L2 can be merged into a single reactor L3, as shown in FIG. 5. The reactor L3 is provided with a magnetic flux closed-loop iron core 5 and a coil L3, a part of section of the magnetic flux closed-loop iron core 5 has a larger sectional area, and the sectional area of the rest section of the iron core is smaller; the coil L3 is winded on the iron core at the section with the larger sectional area. When the current is relatively small, the closed-loop iron core is unsaturated; the coil L3 is equivalent to the saturable reactor L2. When the current is relatively large, the iron core at the section with the smaller sectional area of the closed-loop iron core is saturated, and the iron core at the section with the larger sectional area is unsaturated; the reactance of the coil L3 is decreased to a smaller value quickly, and at this time, the coil L3 is equivalent to the linear reactor L1.

As shown in FIG. 5, one reactor L3 can serve instead of the linear reactor L1 and the saturable reactor L2, thus the volume of the reactor is reduced.

EMBODIMENT 2

Figure 6:
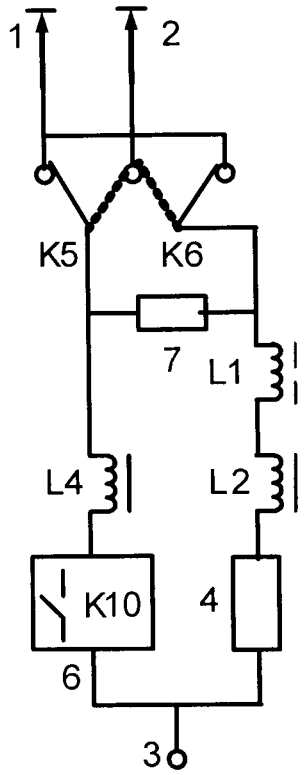
FIG. 6 shows a structure and a connecting manner of a second thyristor assisted on-load tap changer.

The second thyristor assisted on-load tap changer in the present invention is as shown in FIG. 6. It includes two tap selector terminals I1,II2, a common terminal 3, two change-over switches K5, K6, a thyristor switch 6 controlled by a control switch K10, an overvoltage triggering thyristor circuit 4, a linear reactor L1, two saturable reactors L2, L4 and a bidirectional voltage stabilizing circuit 7; one tap terminal of the change-over switch K5 and one tap terminal of the change-over switch K6 are jointly connected with the tap selector terminal I1, the other tap terminal of the change-over switch K5 and the other tap terminal of the change-over switch K6 are jointly connected with the tap selector terminal II2; the common terminal of the change-over switch K5 is serially connected with the common terminal 3 of the on-load tap changer through the saturable reactor L4 and the thyristor switch 6 controlled by the control switch K10 to form a main path; the common terminal of the change-over switch K6 is serially connected with the common terminal 3 of the on-load tap changer through the linear reactor L1, the saturable reactor L2 and the overvoltage triggering thyristor circuit 4 to form a transition path; the bidirectional voltage stabilizing circuit 7 is connected between the common terminal of the change-over switch K5 and the common terminal of the change-over switch K6.

Figure 7:
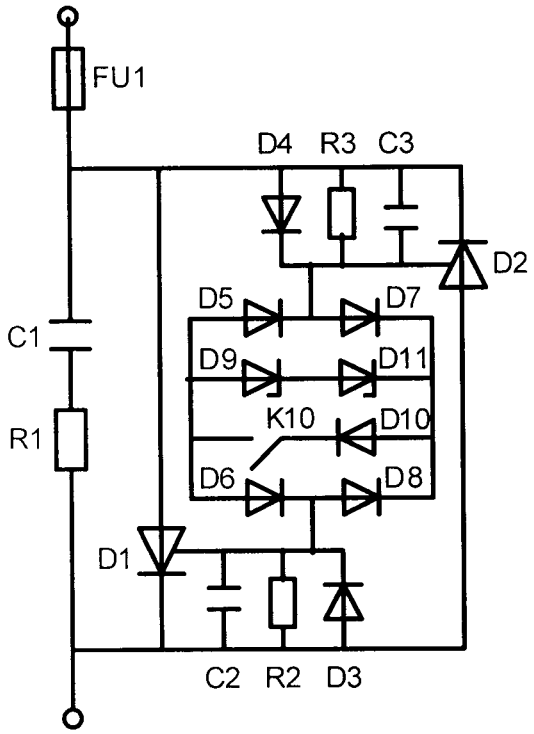
FIG. 7 shows a thyristor switching circuit.

The circuit of the thyristor switch 6 controlled by the control switch K10 is as shown in FIG. 7, and FIG. 7 is obtained by changing on the basis of FIG. 3. As for the part of FIG. 7 the same as FIG. 3, characteristics and parameter requirements are also the same and will not be repeated redundantly herein.

The difference between FIG. 7 and FIG. 3 lies in that: a diode D10 and the control switch K10 are added. The anode of the diode D10 is connected with the anode of a full-bridge rectifier composed of diodes D5, D6, D7, D8, the cathode of the diode D10 is connected with one end of the switch K10, and the other end of the switch K10 is connected with the cathode of the full-bridge rectifier composed of the diodes D5, D6, D7, D8. It can be seen from FIG. 7 that, if the switch K10 is conducted, the thyristor switch 6 is conducted, and if the switch K10 is disconducted, the thyristor switch 5 is disconducted. After the control switch K10 is switched on, the current passing by the control switch K10 is thyristor triggering current, and the current is very small. The conduction and disconduction of the high current path of the thyristor switch 6 can be controlled by the small capacity control switch K10, in order to reduce the electric arc generated by the cutoff of the load current and improve the control speed and sensitivity of the switch.

The difference between FIG. 7 and FIG. 3 also lies in that: a constant voltage diode D11 is added. The constant voltage diode D11 and the constant voltage diode D9 are serially connected in the same direction to replace the original constant voltage diode D9. The constant voltage diode D11 is serially connected with the constant voltage diode D9 to achieve the following two functions:

(1) overvoltage protection of the thyristor switch 6;

(2) when the thyristor switch 6 is applied to a high voltage level on-load tap changer, the withstand voltages of the existing thyristors D1, D2 may be inadequate, and multiple thyristor switches 6 must be serially connected to improve the working voltage, just as shown in FIG. 4. Since each stage of thyristor switch 6 is provided with a control switch K10, the actions of the control switches K10 may be asynchronous, and under the condition that the actions of the control switches K10 are asynchronous, the constant voltage diode D11 and the constant voltage diode D9 can ensure that the thyristor switches 6 act correctly.

If the stabilized voltage of the serially connected constant voltage diode D11 and the constant voltage diode D9 is too small, the pulse generated by the overvoltage triggering thyristor circuit 4 causes wrong conduction of the thyristor switch 6. If the stabilized voltage of the serially connected constant voltage diode D11 and the constant voltage diode D9 is too large, the withstand voltages of the thyristors D1, D2 are required to be increased, thus increasing the volume and investment of the on-load tap changer. If the stabilized voltage of the constant voltage diode D9 is too large, the multiple serially connected thyristor switches 6 cannot achieve the function of the above-mentioned second item. The stabilized voltage $U_3$ of the serially connected constant voltage diode D11 and the constant voltage diode D9 is equal to $k_2(U_1+U_2)$; $k_2$ refers to a confidence coefficient and is a value of 1.1-1.5. After the thyristor D1 (D2) is conducted, the thyristor D1 (D2) has a diode forward voltage drop, the diode forward voltage drop of the thyristor D1 (D2) increases with the increase of the current flowing by. It is assumed that the diode forward voltage drop of the maximum current (including the transient peak value of the short circuit current possibly flowing by) flowing by the thyristor D1 (D2) is $U_4$. After the switch K10 is switched on, the current firstly passes by the diode D10 and the switch K10 to trigger the gate electrode of the thyristor D1 (D2) to conduct the thyristor D1 (D2). The voltages at the two ends of the thyristor D1 (D2) quickly reduce to the diode forward voltage drop, if the sum of the diode forward voltage drops of all semiconductors serially connected in the gate electrode trigger path of the thyristor D1 (D2) is larger than $U_4$, the current of the gate electrode loop of the thyristor D1 (D2) automatically disappears; if the sum of the diode forward voltage drops of all the semiconductors serially connected in the gate electrode trigger path of the thyristor D1 (D2) is smaller than $U_4$, high current flows by the gate electrode loop of the thyristor D1 (D2) to damage the thyristor D1 (D2). When the sum of the diode forward voltage drops of all the semiconductors of the gate electrode trigger path of the thyristor D1 (D2) is smaller than $1.2U_4$, multiple diodes can be serially connected to form D10 to improve the diode forward voltage drop of the diode D10. If too many diodes D10 are serially connected, heating will be increased, and the waveform of the zero-crossing current goes bad. The sum of the diode forward voltage drops of all the semiconductors serially of the gate electrode trigger path of the thyristor D1 (D2) is properly about 1.5th Namely, the sum of the diode forward voltage drops of the diodes D4, D7, D10, D6 and the gate electrode of the thyristor D1 is about $1.5U_4$, and the sum of the diode forward voltage drops of the diodes D3, D8, D10, D5 and the gate electrode of the thyristor D2 is about $1.5U_4$.

In this embodiment, a combination of the saturable reactor L4 and the thyristor switch 6 is used instead of the main vacuum switch K1 of the main path in embodiment 1. The anti-interference capability of the main vacuum switch K1 is very strong, but the operation of the main vacuum switch K1 needs a larger mechanical force, thus the operation is insensitive; an electric arc exists in the disconnection process of the contact to generate interference with other semiconductor devices. The control switch K10 of the thyristor switch 6 can be a miniature relay with a contact and can also be a solid-state switch without contact, the control voltage of the solid-state switch without contact is small, and the action is faster and more sensitive; the interference with other semiconductor devices is small. The working principle and the control circuit of the solid-state switch without contact are public knowledge, and are not repeated redundantly. The defect of the thyristor switch 6 lies in that wrong action may be caused by the pulse interference. To improve the anti-interference capability of the thyristor switch 6, the saturable reactor L4 is serially connected. One function of the saturable reactor L4 is to reduce the rate of rise of the current at the connection moment of the thyristor D1 (D2) in the thyristor switch 6. The other function of the saturable reactor L4 is as follows: the saturable reactor L4 cooperates with the resistor R1 and the capacitor C1 in the thyristor switch 6 to improve the anti-interference capability of the thyristor switch 6.

The working process of switching the conduction of the tap selector terminal I1 of the on-load tap changer with the common terminal 3 to the conduction of the tap selector terminal II2 with the common terminal 3 is as follows: (1) switching the change-over switch K6; (2) switching off the control switch K10; switching off the main path, and automatically switching on the transition path; (3) switching the change-over switch K5; (4) switching on the control switch K10.

EMBODIMENT 3

Figure 8:
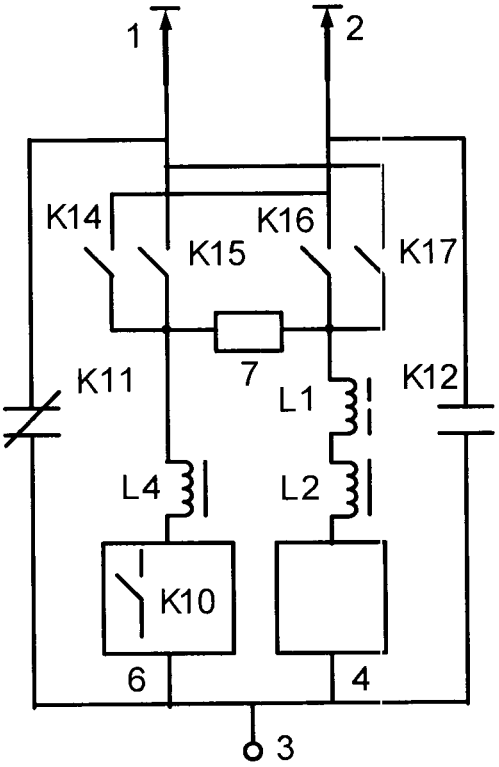
FIG. 8 shows a structure and a connecting manner of a third thyristor assisted on-load tap changer.

The third thyristor assisted on-load tap changer in the present invention is as shown in FIG. 8. It includes two tap selector terminals I1,II2, a common terminal 3, an odd-numbered side main contact K11, an even-numbered side main contact K12, four transition switches K14, K15, K16, K17, an overvoltage triggering thyristor circuit 4, a thyristor switch 6 controlled by a control switch K10, a linear reactor L1, two saturable reactors L2, L4 and a bidirectional voltage stabilizing circuit 7; the tap selector terminal I1 is respectively connected with the transition switches K15, K17, and the tap selector terminal II2 is respectively connected with the transition switches K14, K16; the other terminals of the transition switches K14, K15 are jointly connected and are serially connected with the common terminal 3 of the on-load tap changer through the saturable reactor L4 and the thyristor switch 6 controlled by the control switch K10 to form a main path; the other terminals of the transition switches K16, K17 are jointly connected and are serially connected with the common terminal 3 of the on-load tap changer through the linear reactor L1, the saturable reactor L2 and the overvoltage triggering thyristor circuit 4 to form a transition path; the two ends of the odd-numbered side main contact K11 are respectively connected with the tap selector terminal I1 and the common terminal 3 of the on-load tap changer, and the two ends of the even-numbered side main contact K12 are respectively connected with the tap selector terminal II2 and the common terminal 3 of the on-load tap changer; the bidirectional voltage stabilizing circuit 7 is connected between the connecting terminal of the transition switches K14, K15 and the connecting terminal of the transition switches K16, K17.

The thyristor switch 6 is controlled by the switch K10, if K10 is conducted, the thyristor switch 6 is conducted, and if K10 is disconducted, the thyristor switch 6 is disconducted.

The odd-numbered side main contact K11 and the even-numbered side main contact K12 of FIG. 8 are contactors with locks and are composed of closing coils, breaking (unlocking) coils, main contacts and auxiliary contacts. The four transition switches K14, K15, K16, K17 are contactors without locks and are composed of closing coils, main contacts and auxiliary contacts.

The odd-numbered side main contact K11 and the even-numbered side main contact K12 are responsible for a long-term energization task. The thyristor switch 6 and the overvoltage triggering thyristor circuit 4 can work for a short period of time, and the thyristor D1 (D2) needs no complicated cooling plate.

Figure 9:
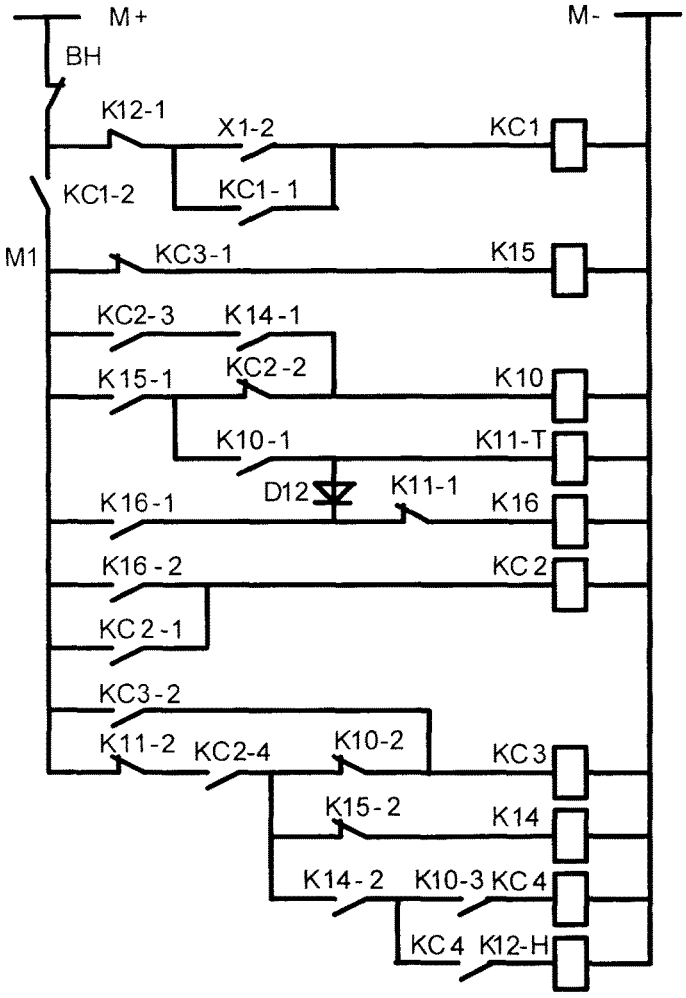
FIG. 9 shows a switcher control circuit of a third thyristor assisted on-load tap changer.

The switcher control circuit for switching the conduction of the tap selector terminal I1 of the on-load tap changer with the common terminal 3 to the conduction of the tap selector terminal II2 with the common terminal 3 is as shown in FIG. 9.

M+ refers to a positive bus of a control power supply, and M− refers to a negative bus of the control power supply; K11-T refers to the breaking (unlocking) coil of the K11 contactor, and K11-1 and K11-2 refer to the auxiliary contacts of the K11 contactor; K12-H refers to the closing coil of the K12 contactor, and K12-1 refers to the auxiliary contact of the K12 contactor. K14-1, K14-2, K15-1, K15-2, K16-1 and K16-2 respectively refer to the auxiliary contacts of the transition switches K14, K15, K16, K10-1, K10-2 and K10-3 refer to the auxiliary contacts of the control switch K10, and KC1, KC2, KC3 and KC4 refer to intermediate relays; BH refers to a protection outlet contact, when the action of the on-load tap changer is protected and inhibited, the BH contact is open to cut off the power supply of a control circuit M1; X1-2 refers to a tap selector instruction contact of the on-load tap changer, after the tap selector of the on-load tap changer selects the tap, the X1-2 contact is switched on to notify the control circuit of the on-load tap changer to start working.

After being serially connected with the BH contact, the positive bus M+ of the control power supply is connected with one end of the KC1-2 contact, and the other end of the KC1-2 contact is connected with an M1 bus; a node between the BH contact and the KC1-2 contact serially connects the K12-1 auxiliary contact, the X1-2 contact and the KC1 coil to the M− bus; the KC1-1 contact is connected with the two ends of the X1-2 contact in parallel; M1 serially connects the KC3-1 contact and the K15 coil to the M− bus; M1 serially connects the K15-1 contact, the KC2-2 contact and the K10 coil to the M− bus; M1 serially connects the KC2-3 contact and the K14-1 contact to a node between the KC2-2 contact and the K10 coil; a node between the K15-1 contact and the KC2-2 coil serially connects the K10-1 contact and the K11-T coil to the M− bus; M1 serially connects the K16-1 contact, the K11-1 contact and the K16 coil to the M− bus; a node between the K16-1 contact and the K11-1 contact is connected with the cathode of a diode D12, and a node between the K10-1 contact and the K11-T coil is connected with the anode of the diode D12; M1 serially connects the K16-2 contact and the KC2 coil to the M− bus; the KC2-1 contact is connected with the K16-2 contact in parallel; M1 serially connects the K11-2 contact, the KC2-4 contact, the K10-2 contact and the KC3 coil to the M− bus; M1 serially connects the KC3-2 contact to a node between the K10-2 contact and the KC3 coil; a node between the KC2-4 contact and the K10-2 contact serially connects the K15-2 contact and the K14 coil to the M− bus; the node between the KC2-4 contact and the K10-2 contact serially connects the K14-2 contact, the K10-3 contact and the KC4 coil to the M− bus; a node between the K14-2 contact and the K10-3 contact serially connects the KC4 contact and the K12-H coil to the M− bus.

The working process of switching the conduction of the tap selector terminal I1 with the common terminal 3 to the conduction of the tap selector terminal II2 with the common terminal 3 is illustrated as follows:

when the X1-2 contact is switched on, the K12 contact and the X1-2 contact are switched on, the KC1 coil is energized, the KC1-1 and KC1-2 contacts are switched on, and the control circuit M1 transmits power and is self-holding.

The KC3-1 normally open contact is switched on, the K15 coil is energized, the transition switch K15 of FIG. 8 is switched on, and the thyristor switch 6 controlled by the control switch K10 is conducted with the odd-numbered side main contact K12 in parallel; the K15-1 contact is switched on and the KC2-2 normally closed contact is switched on to connect the K10 coil, and the thyristor switch 6 controlled by the control switch K10 of FIG. 8 is switched on; the K15-1 contact is switched on and the K10-1 contact is switched on to conduct the coil K11-T, the odd-numbered side main contact K11 of FIG. 8 is switched off, and the load current is transferred to the path of the thyristor switch 6; the K15-1 contact is switched on, the K10-1 contact is switched on and the K11-1 contact is switched on to conduct the K16 coil; the K16-1 contact is switched on to self hold to conduct the K16 coil, the transition switch K16 of FIG. 8 is switched on, and the overvoltage triggering thyristor circuit 4 is switched on; the K16-2 contact is switched on to conduct the KC2 coil, and KC2-1 is switched on to self hold to conduct the KC2 coil; the KC2-2 contact is switched off, the K10 coil is de-energized, the thyristor switch 6 controlled by the control switch K10 of FIG. 8 is disconducted, and the load current is transferred to the path of the overvoltage triggering thyristor circuit 4; the K10-1 contact is switched off, and the diode D12 prevents K16-1 from transmitting power to the coil K11-T; the K11-2 contact is switched on, the KC2-4 contact is switched on and the K10-2 contact is switched on to conduct the KC3 coil; the KC3-2 contact is switched on to self hold to conduct the KC3 coil; the KC3-1 contact is switched off, and the K15 coil is de-energized; the transition switch K15 of FIG. 8 is switched off, the K15-2 contact is switched on to conduct the K14 coil, and the transition switch K14 of FIG. 8 is switched on to conduct the thyristor switch 6 controlled by the control switch K10 with the overvoltage triggering thyristor circuit 4 in parallel; the K14-1 contact is switched on to conduct the K10 coil again, the thyristor switch 6 controlled by the control switch K10 of FIG. 8 is switched on again, and the load current is transferred to the path of the thyristor switch 6 controlled by the control switch K10 again; the K10-3 contact is switched on to conduct the KC4 coil; the KC4 contact is switched on to conduct the K12-H coil, the K12 main contact of FIG. 8 is switched on, and the load current is transferred to the path of the K12 main contact to connect the tap selector terminal II2 with the common terminal 3; meanwhile, the K12 normally closed contact is switched off, the KC1 coil is de-energized, the KC1-1 contact and the KC1-2 contact are switched off to cut off the power supply of the control circuit, and the entire group of the control circuit is reset.

In the above-mentioned switcher control circuit, the transition switch K15 is switched on firstly, and the control switch K10 is switched on; the program is clear. Or, the transition switch K15 and the control switch K10 can also be simultaneously switched on to shorten the overall time of the program. In the above-mentioned switcher control circuit, the odd-numbered side main contact K11 is firstly switched off, and after the load current is transferred to the path of the thyristor switch 6, the transition switch K16 is switched on to access the overvoltage triggering thyristor circuit 4; the program is clear. Or, the odd-numbered side main contact K12 is switched off and the transition switch K16 is switched on at the same time to shorten the overall time of the program.

The switcher control circuit for switching the conduction of the tap selector terminal II2 of the on-load tap changer with the common terminal 3 to the conduction of the tap selector terminal I1 with the common terminal 3 can refer to the above-mentioned method design, and will not be repeated redundantly.

The traditional on-load tap changer adopts a motor rotation driving manner, the overall action time is 4.4 seconds, wherein the action time of the diverter switch is only 40 milliseconds, and most of the time is used as energy accumulating and preparation time of the mechanical mechanism. For the thyristor assisted on-load tap changer in which the overvoltage triggering thyristor circuit 4 is used instead of the transition resistor R, the action time of the diverter switch is prolonged without heating to damage the equipment, in this way, the energy accumulating mechanical mechanism can be eliminated, and the overall action time of the thyristor assisted on-load tap changer can be shortened on the contrary. The complicated mechanical linkage mechanism and energy accumulating mechanical mechanism are eliminated to reduce the volume and weight of the on-load tap changer; the failure rate can be reduced. In particular, the control circuit in the manner of the intermediate relay (contactor) can be adopted to achieve the sequential action of the switcher. The control manner of the intermediate relay (contactor) is adopted to ensure entering the action program of the next switch after the action of a certain switch is finished, in order to improve the reliability. The action of the tap selector needs no intervention of the switcher, the switcher is started to work after the action of the tap selector is finished, and no intervention of the tap selector is needed in the switch process of the switcher; the tap selector and the switcher need no constraint of a mechanical linkage, and are clear in logical relationship, simple in structure and convenient to cooperate. In the thyristor assisted on-load tap changer as shown in FIG. 8, no current flow is generated in the disconduction and conduction processes of the odd-numbered side main contact K11, the even-numbered side main contact K12 and the four transition switches K14, K15, K16, K17; arc-free switch is achieved; the switch contact is not damaged by frequent action.

According to some preference, the thyristor assisted on-load tap changer can be changed based on this embodiment. For example: (1) a set of the overvoltage triggering thyristor circuit 4, the transistor switch 6, the linear reactor L1 and the saturable reactor L2 can be added, in this way, the four transition switches K14, K15, K16, K17 can be reduced to two, to achieve the purpose of reducing the number of the mechanical switches. (2) The overvoltage triggering thyristor circuit 4 and the transistor switch 6 have a large amount of identical elements and circuits; FIG. 3 and FIG. 7 can be combined to form a set of new combined circuit, the combined circuit can be switched between the two functions of the main path and the transition path by means of the switch on or switch off of a miniature switch, thus one set of circuit has two functions. After being serially connected with such set of combined circuit, one transition switch is connected with the tap selector terminal I1 and the common terminal 3 in parallel; after being serially connected with another such set of combined circuit, another transition switch is connected with the tap selector terminal II2 and the common terminal 3 in parallel, in order to reduce the number of the mechanical switches, reduce the semiconductor elements, reduce the operation steps and shorten the switch time.

According to some preference, the switcher control circuit as shown in FIG. 9 can be changed based on this embodiment. The control circuit with equivalent program and time sequence requirements can be implemented in multiple methods. The control circuit can not only be implemented by the logic cooperation of miniature intermediate relays, but also can be implemented by semiconductor devices. These are public knowledge and will not be repeated redundantly.

EMBODIMENT 4

The principle structure and the connecting manner of a thyristor assisted on-load tap changer in the present invention are as shown in FIG. 2. It includes two tap selector terminals I1,II2, a common terminal 3, two change-over switches K5, K6, a main vacuum switch K1, an overvoltage triggering thyristor circuit 4, a linear reactor L1, a saturable reactor L2 and a bidirectional voltage stabilizing circuit 7; one tap terminal of the change-over switch K5 and one tap terminal of the change-over switch K6 are jointly connected with the tap selector terminal I1, the other tap terminal of the change-over switch K5 and the other tap terminal of the change-over switch K6 are jointly connected with the tap selector terminal II2; the common terminal of the change-over switch K5 is connected with the common terminal 3 of the on-load tap changer through the main vacuum switch K1 to form a main path; the common terminal of the change-over switch K6 is serially connected with the common terminal 3 of the on-load tap changer through the linear reactor L1, the saturable reactor L2 and the overvoltage triggering thyristor circuit 4 to form a transition path; the bidirectional voltage stabilizing circuit 7 is connected between the common terminal of the change-over switch K5 and the common terminal of the change-over switch K6.

The main vacuum switch K1 and the change-over switches K5, K6 are contactors with locks and are composed of closing coils, breaking coils, main contacts and auxiliary contacts.

Figure 10:
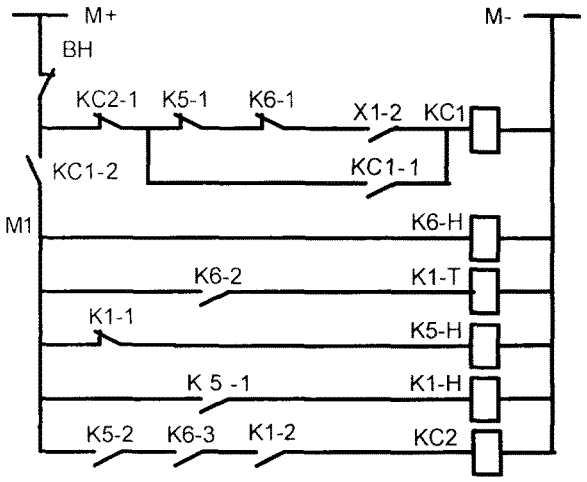
FIG. 10 shows a switcher control circuit of a thyristor assisted on-load tap changer.

The sequential action of the switches is achieved by a switcher control circuit of the on-load tap changer, as shown in FIG. 10. M+ refers to a positive bus of a control power supply, and M− refers to a negative bus of the control power supply; K1-T refers to the breaking coil of the K1 switch, and K1-H, K5-H and K6-H respectively refer to the closing coils of the K1, K5 and K6 switches. K1-1, K1-2, K5-1, K5-2, K6-1, K6-2 and K6-3 respectively refer to the auxiliary contacts of the K1, K5 and K6 switches, and KC1 and KC2 refer to intermediate relays; BH refers to a protection outlet contact, when the action of the on-load tap changer is protected and inhibited, the BH contact is disconducted to cut off the power supply of a control circuit M1; X1-2 refers to a tap selector instruction contact of the on-load tap changer, after the tap selector of the on-load tap changer selects the tap, the X1-2 contact is switched on to notify the control circuit of the on-load tap changer to start working.

The switcher control circuit controls the power supply connection sequence of the switch coils according to the action sequence of the contacts, in order to achieve the sequential action of a series of electric switches and achieve the on-load switch of the on-load tap changer. The working method of the switcher control circuit refers to embodiment 3, and will not be repeated redundantly.

EMBODIMENT 5

The principle structure and the connecting manner of a thyristor assisted on-load tap changer in the present invention are as shown in FIG. 6. It includes two tap selector terminals I1,II2, a common terminal 3, two change-over switches K5, K6, a thyristor switch 6 controlled by a control switch K10, an overvoltage triggering thyristor circuit 4, a linear reactor L1, two saturable reactors L2, L4 and a bidirectional voltage stabilizing circuit 7; one tap terminal of the change-over switch K5 and one tap terminal of the change-over switch K6 are jointly connected with the tap selector terminal I1, the other tap terminal of the change-over switch K5 and the other tap terminal of the change-over switch K6 are jointly connected with the tap selector terminal II2; the common terminal of the change-over switch K5 is serially connected with the common terminal 3 of the on-load tap changer through the saturable reactor L4 and the thyristor switch 6 controlled by the control switch K10 to form a main path; the common terminal of the change-over switch K6 is serially connected with the common terminal 3 of the on-load tap changer through the linear reactor L1, the saturable reactor L2 and the overvoltage triggering thyristor circuit 4 to form a transition path; the bidirectional voltage stabilizing circuit 7 is connected between the common terminal of the change-over switch K5 and the common terminal of the change-over switch K6.

The control switch K10 and the change-over switches K5, K6 are contactors with locks and are composed of closing coils, breaking coils, main contacts and auxiliary contacts.

Figure 11:
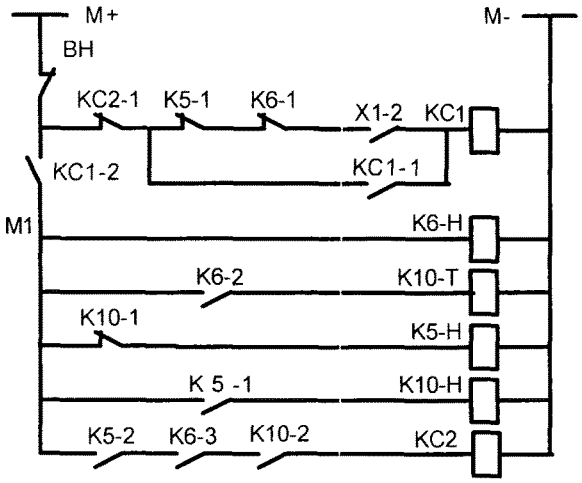
FIG. 11 shows a switcher control circuit of a second thyristor assisted on-load tap changer.

The sequential action of the switches is achieved by a switcher control circuit of the on-load tap changer, as shown in FIG. 11. M+ refers to a positive bus of a control power supply, and M− refers to a negative bus of the control power supply; K10-T refers to the breaking coil of the K10 switch, and K10-H, K5-H and K6-H respectively refer to the closing coils of the K10, K5 and K6 switches. K10-1, K10-2, K5-1, K5-2, K6-1, K6-2 and K6-3 respectively refer to the auxiliary contacts of the K10, K5 and K6 switches, and KC1 and KC2 refer to intermediate relays; BH refers to a protection outlet contact, when the action of the on-load tap changer is protected and inhibited, the BH contact is disconducted to cut off the power supply of a control circuit M1; X1-2 refers to a tap selector instruction contact of the on-load tap changer, after the tap selector of the on-load tap changer selects the tap, the X1-2 contact is switched on to notify the control circuit of the on-load tap changer to start working.

The switcher control circuit controls the power supply connection sequence of the switch coils according to the action sequence of the contacts, in order to achieve the sequential action of a series of electric switches and achieve the on-load switch of the on-load tap changer. The working method of the switcher control circuit refers to embodiment 3, and will not be repeated redundantly.

EMBODIMENT 6

In embodiments 1, 2, 3, 4, 5, an on-load tap changer switcher is habitually referred to as the on-load tap changer. In the following embodiments 6, 7, 8, 9, in order to express details, the tap selector and the switcher of the thyristor assisted on-load tap changer are specially expressed by a tap selector 10 and a switcher 11. The tap selector 10 is connected with the taps of a regulating transformer, the switcher 11 is connected with the tap selector 10, and after the tap selector 10 selects the tap of the regulating transformer, the switcher 11 achieves the on-load switch of two taps of the regulating transformer. A tap selector terminal I1 and the terminal J1 of the switcher 11 are connected to a point, thus the tap selector terminal I1 and the terminal J1 of the switcher 11 can be considered as the same terminal; a tap selector terminal II2 and the terminal J2 of the switcher 11 are connected to a point, thus the tap selector terminal II2 and the terminal J2 of the switcher 11 can be considered as the same terminal; a common terminal 3 of the on-load tap changer is actually a switcher terminal J3.

In some application occasions, L1 in the switcher (as shown in FIG. 8) of the third thyristor assisted on-load tap changer can be removed, and the rest part can still work. On the premise of small safety loss, the economical efficiency is improved.

In some application occasions, L1, L2 and L4 in the switcher (as shown in FIG. 8) of the third thyristor assisted on-load tap changer can be removed, and the rest part can still work. On the premise of small safety loss, the economical efficiency is further improved.

Figure 13:
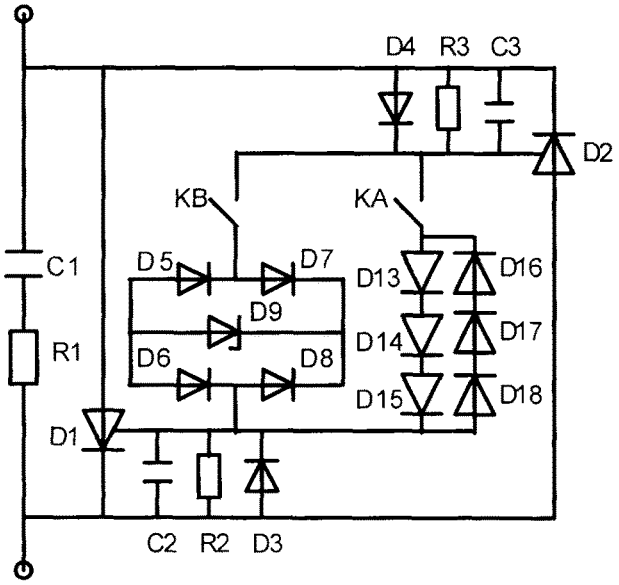
FIG. 13 shows an economical thyristor assisted circuit.

After L1, L2 and L4 in the switcher (as shown in FIG. 8) of the third thyristor assisted on-load tap changer are removed, the thyristor switch 6 in the main path and the overvoltage triggering thyristor circuit 4 in the transition path can be replaced by an economical thyristor assisted circuit as shown in FIG. 13; KA in the economical thyristor assisted circuit as shown in FIG. 13 represents K10, KB is switched off, and the economical thyristor assisted circuit is equivalent to the thyristor switch 6; KA in the economical thyristor assisted circuit as shown in FIG. 13 is switched off, KB is switched on, and the economical thyristor assisted circuit is equivalent to the overvoltage triggering thyristor circuit 4. In this way, two economical thyristor assisted circuits (an economical thyristor assisted circuit I8 and an economical thyristor assisted circuit II9) respectively form two paths, and the two paths respectively have the functions of the main path and the transition path. By means of the control of the four small capacity switches KA (K23-1) and KB (K25-1) in the economical thyristor assisted circuit I8 and KA (K24-1) and KB (K26-1) in the economical thyristor assisted circuit II9, the same functions of K14, K15, K16, 17 in FIG. 8 are achieved. When the economical thyristor assisted circuit I8 is used as the main path, the economical thyristor assisted circuit II9 is used as the transition path; when the economical thyristor assisted circuit II9 is used as the main path, the economical thyristor assisted circuit I8 is used as the transition path.

Figure 12:
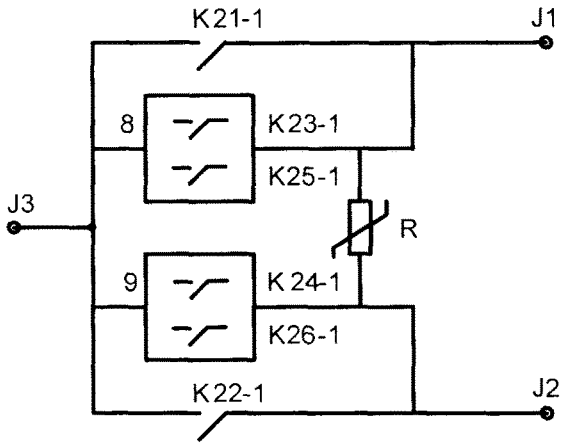
FIG. 12 shows a structure of a switcher of a fourth thyristor assisted on-load tap changer.

The structure and the connecting manner of the switcher 11 of the fourth thyristor assisted on-load tap changer are as shown in FIG. 12. It includes a main switch K21-1, a main switch K22-1, an economical thyristor assisted circuit I8, an economical thyristor assisted circuit II 9, a piezoresistor R and three terminals J1, J2, J3; the terminal J1 is connected with the odd-numbered terminal of the tap selector, the terminal J2 is connected with the even-numbered terminal of the tap selector, and the terminal J3 is a common terminal. One end of the main switch K21-1 is connected with the terminal J1, and the other end of the main switch K21-1 is connected with the terminal J3; the economical thyristor assisted circuit I is connected with the main switch K21-1 in parallel; one end of the main switch K22-1 is connected with the terminal J2, and the other end of the main switch K22-1 is connected with the terminal J3; the economical thyristor assisted circuit II is connected with the main switch K22-1 in parallel; the end of the economical thyristor assisted circuit I close to the J1 and the end of the economical thyristor assisted circuit II close to the J2 are further connected with the piezoresistor R. The functions and requirements of the piezoresistor R are the same as those of 7 in FIG. 8, and will not be repeated redundantly herein.

The economical thyristor assisted circuit I8 and the economical thyristor assisted circuit II 9 have the same structure and parameters, thus only one schematic diagram is given, as shown in FIG. 13. It includes: a pair of thyristors D1, D2 are reversely connected in parallel to form a main path of the economical thyristor assisted circuit; a resistor R1 and a capacitor C1 are connected to the two ends of the thyristors D1, D2 reversely connected in parallel after being connected in series; the gate electrodes and the cathodes of the two thyristors D1, D2 are respectively connected with capacitors C2, C3, resistors R2, R3 and diodes D3, D4; the anodes of the diodes D3, D4 are respectively connected with the gate electrodes of the thyristors D1, D2, and the cathodes of the diodes D3, D4 are respectively connected with the cathodes of the thyristors D1, D2; the input terminal of a full-bridge rectifier composed of diodes D5, D6, D7, D8 is connected between the gate electrodes of the two thyristors D1, D2 after being serially connected with a switch KB, the output end of the full-bridge rectifier is connected with a constant voltage diode D9, the cathode of the constant voltage diode D9 is connected with the anode output end of the full-bridge rectifier, and the anode of the constant voltage diode D9 is connected with the cathode output end of the full-bridge rectifier; diodes D13, D14, D15 are serially connected in the same direction, diodes D16, D17, D18 are serially connected in the same direction, and the two diode strings are serially connected with the switch KA after being reversely connected in parallel and are connected between the gate electrodes of the two thyristors D1, D2.

KA of the economical thyristor assisted circuit I8 is expressed by K23-1 in FIG. 12, and KB is expressed by K25-1 in FIG. 12; KA of the economical thyristor assisted circuit II 9 is expressed by K24-1 in FIG. 12, and KB is expressed by K26-1 in FIG. 12. Under the condition that KB is switched off, the economical thyristor assisted circuits I8 and II2 are equivalent to a switching circuit controlled by KA. It can be seen from FIG. 13 that, if the switch KA is conducted, the economical thyristor assisted circuit is conducted, and if the switch KA is disconducted, the economical thyristor assisted circuit is disconducted. After the switch KA is switched on, the current passing by the switch KA is thyristor triggering current, and the current is very small. The conduction and disconduction of the high current path of the thyristors D1, D2 can be controlled by the small capacity switch KA, in order to reduce the electric arc generated by the cutoff of the load current and improve the control speed and sensitivity of the switch. After the switch KA is switched on, the current passes by the switch KA to trigger the gate electrode of the thyristor D1 (D2) to conduct the thyristor D1 (D2). The voltages at the two ends of the thyristor D1 (D2) quickly reduce to the diode forward voltage drop of the thyristor D1 (D2), if the sum of the diode forward drops of all semiconductors serially connected in the gate electrode trigger path of the thyristor D1 (D2) is larger than the diode forward voltage drop of the thyristor D1 (D2), the current of the gate electrode loop of the thyristor D1 (D2) automatically disappears; if the sum of the diode forward voltage drops of all the semiconductors serially connected in the gate electrode trigger path of the thyristor D1 (D2) is smaller than the diode forward voltage drop of the thyristor D1 (D2), high current flows by the gate electrode loop of the thyristor D1 (D2) to damage the thyristor D1 (D2). In FIG. 13, diodes D13, D14, D15 are connected in the same direction to form a diode string, diodes D16, D17, D18 are connected in the same direction to form another diode string, and the two diode strings are connected between the gate electrodes of the two thyristors D1, D2 after being reversely connected in parallel and serially connected with the normally open switch KB, in order to improve sum of the diode forward voltage drop of the trigger circuit of the thyristor D1 (D2). The more the serially connected diodes are, the better the effect of ensuring zero current flowing by the switch KA after the thyristors D1, D2 are connected is; however, if too many diodes are serially connected, heating will be increased, and the waveform of the zero-crossing current goes bad. It is proper to serially connect three diodes positively and negatively, respectively.

Under the condition that KA is switched off and KB is switched on, the economical thyristor assisted circuit I8 and the economical thyristor assisted circuit II9 are equivalent to overvoltage triggering thyristor circuits. The stabilized voltage $U_1$ of a constant voltage diode D9 is equal to $k_1U_2$; $k_1$ refers to a confidence coefficient and is a value of 1.2-2; $U_2$ refers to the peak value of a rated working frequency operating voltage between the connecting terminals J1, J2 of the switcher and the tap selector of the thyristor assisted on-load tap changer. It is recommended that $k_1$ is preferably 1.5. The working property of the overvoltage triggering thyristor circuit is the same as that in embodiment 1, and will not be repeated redundantly. The economical thyristor assisted circuits I8 and II9 are simple in structure and are high in reliability.

The conduction of the switcher terminal J1 of the on-load tap changer with the common terminal J3 can be switched to the conduction of the terminal J2 with the common terminal J3; the conduction of the switcher terminal J2 of the on-load tap changer with the common terminal J3 can be switched to the conduction of the terminal J1 with the common terminal J3. The working method of switching the conduction of the terminal J1 of the switcher of the on-load tap changer with the common terminal J3 to the conduction of the terminal J2 with the common terminal J3 is described as follows:

before switching, the main switch K21-1 is switched on, the main switch K22-1 is switched off, and the switches K23-1, K24-1, K25-1, K26-1 are switched off. A power system is connected with one odd-numbered tap of a regulating transformer through the common terminal J3, the main switch K21-1, the terminal J1 of the switcher 11 and the tap selector 10. The on-load tap changer receives a regulation instruction and firstly commands the tap selector 10 to select to switch on a corresponding even-numbered tap changer, and the selection of the tap selector 10 is finished. The working sequence of the switcher 11 is as follows:

(1) the switch K23-1 is switched on; the switch K26-1 is switched on. When the switch K23-1 is switched on, the economical thyristor assisted circuit I8 is used as a conducted switch access circuit. When the switch K26-1 is switched on, the economical thyristor assisted circuit II9 is used as the access circuit of the overvoltage triggering thyristor circuit, since the peak value of the maximum normal AC voltage is smaller than the stabilized voltage of the constant voltage diode D9, the constant voltage diode D9 is not conducted, and the overvoltage triggering thyristor circuit is not conducted.

(2) The main switch K21-1 is switched off. The load current is transferred to the economical thyristor assisted circuit I8.

(3) The switch K23-1 is switched off. The current of the economical thyristor assisted circuit I 8 is cut off at a zero crossing point of the current, at the current cutoff moment of the economical thyristor assisted circuit I 8, the potential of the terminal J3 quickly descends (or ascends); the voltages at the two ends of the economical thyristor assisted circuit II 9 (the overvoltage triggering thyristor circuit) instantaneously generate overvoltages, when the instantaneous value of the overvoltage reaches the stabilized voltage of the constant voltage diode D9, the conduction of the thyristor D1 or thyristor D2 is triggered, the load current flows in from the terminal J2 and flows out from the common terminal J3 through the economical thyristor assisted circuit II 9; the load current is transferred from the economical thyristor assisted circuit I 8 to the economical thyristor assisted circuit II 9.

(4) The switch K24-1 is switched on. The economical thyristor assisted circuit II 9 is used as a conducted switch access circuit.

(5) The main switch K22-1 is switched on. The load current is transferred from the economical thyristor assisted circuit II 9 to the main switch K22-1.

(6) The entire group is reset.

It can be seen that, the switch K24-1 must be only switched on after the switch K23-1 is switched off and the current of the economical thyristor assisted circuit I 8 is cut off at the zero crossing point of the current. Otherwise, the current of the economical thyristor assisted circuit I 8 is cut off in front of the zero crossing point of the current, the switch K24-1 is switched on too early, and the economical thyristor assisted circuit I 8 and the economical thyristor assisted circuit II 9 will cause short circuit circulation. The time between switching off the switch K23-1 and cutting off the current of the economical thyristor assisted circuit I 8 at the zero crossing point of the current is uncertain. To ensure that the switch K24-1 is switched on after the current of the economical thyristor assisted circuit I 8 is cut off at the zero crossing point of the current, the time interval between switching off the switch K23-1 and switching on the switch K24-1 should be larger than 20 milliseconds.

Similarly, the working method of switching the conduction of the terminal J2 of the switcher of the on-load tap changer with the common terminal 3 to the conduction of the terminal J1 and the common terminal 3 is as follows:

before switching, the main switch K22-1 is switched on, the main switch K21-1 is switched off, and the switches K23-1, K24-1, K25-1, K26-1 are switched off; after the tap selector 10 selects the transformer tap; (1) the switch K24-1 is switched on; the switch K25-1 is switched on; (2) the main switch K22-1 is switched off; (3) the switch K24-1 is switched off; (4) the switch K23-1 is switched on; (5) the main switch K21-1 is switched on; (6) the entire group is reset.

The time interval between switching off the switch K24-1 and switching on the switch K23-1 should be larger than 20 milliseconds.

The switches K21-1, K22-1, K23-1, K24-1, K25-1 and, K26-1 can be manually operated, and the electric switches are manually operated to sequentially act in order to achieve the on-load switch of the switcher.

The economical thyristor assisted circuit I 8 and the economical thyristor assisted circuit II 9 are serially connected with a saturable reactor L2 respectively to increase the safety of the switcher I1 of the fourth thyristor assisted on-load tap changer, and the economical efficiency is slightly reduced. In practical application, the balance of the requirements on the safety and the economical efficiency can be considered.

FIG. 12 is compared with FIG. 8. L1, L2, L4 in FIG. 8 are removed in FIG. 12, and four large capacity switches K14, K15, K16, K17 are also removed. K21-1 in FIG. 12 is equivalent to K11 in FIG. 8, K22-1 in FIG. 12 is equivalent to K12 in FIG. 8, and a nonlinear resistor R in FIG. 12 is equivalent to the bidirectional voltage stabilizing circuit 7 in FIG. 8. Four small capacity switches K23-1, K24-1, K25-1, K26-1 are adopted in FIG. 12 to achieve the functions of four large capacity switches K14, K15, K16, K17 and the K10 switch in FIG. 8. The switcher as shown in FIG. 12 has better economical efficiency than the switcher as shown in FIG. 8 and is more convenient to control.

EMBODIMENT 7

In embodiment 6, the switches K21-1, K22-1, K23-1, K24-1, K25-1 and K26-1 can be manually operated, and the electric switches are manually operated to sequentially act in order to achieve the on-load switch of the switcher 11. Actually, in view of the switches K21-1, K22-1, K23-1, K24-1, K25-1 and K26-1, the electric switches can also be driven by a mechanical linkage mechanism to sequentially act to achieve the on-load switch of the switcher; the electric switches can also be controlled by a contactor (relay) contact to sequentially act to achieve the on-load switch of the switcher 11; a variety of methods can be adopted, thus the application is flexible.

In a variety of applications, the switches K21-1, K22-1, K23-1, K24-1, K25-1 and K26-1 are controlled by the contactor (relay) contact to sequentially act to achieve the on-load switch of the switcher 11 more simply and more economically. The main switch K21-1 and the main switch K22-1 are contactors with locks and are composed of closing coils, breaking (unlocking) coils, main contacts (main switches) and auxiliary contacts, the switches K23-1, K24-1, K25-1, K26-1 are contactors (or relays) without locks and are composed of closing coils, main contacts (switches) and auxiliary contacts; the action state of the main contact is reflected by the auxiliary contact of the contactor (relay), namely, it is ensured that the action program of the next switch is entered after the action state of a certain switch is determined and that the action program of the next switch is entered immediately after the action state of the certain switch is determined; a perfect combination of speed and reliability is achieved.

In the structure of the switcher 11 of the fourth thyristor assisted on-load tap changer as shown in FIG. 12, except the main switch, no other large capacity contactor (relay) is needed; the switches K23-1, K24-1, K25-1, K26-1 are small capacity switches, the thyristor trigger circuit can be controlled by the on/off of the contact of a small capacity contactor (relay) to switch on/off a high current thyristor, in order to switch the on-load tap changer. The switcher 11 of the on-load tap changer implemented by the contactor (relay) is simple in structure, convenient to control and low in cost.

The main switch is switched on and switched off under the condition that the voltages at the two ends of the switch are equal to zero, and the main switch is operated in an arc-free manner. The contacts of the small capacity contactors (relays) K23-1, K24-1, K25-1, K26-1 can also be operated in the arc-free manner.

Figure 15:
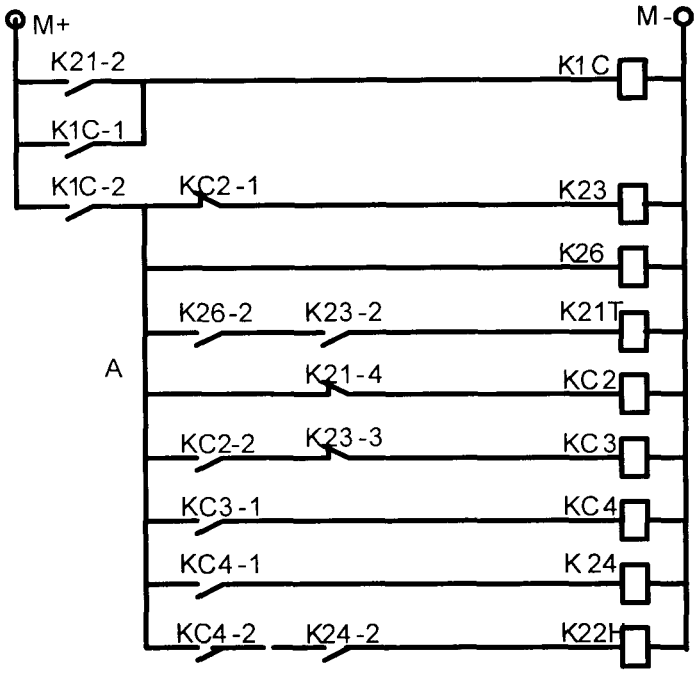
FIG. 15*a* shows a control circuit of a third switching state.
FIG. 15*b* shows a control circuit of a fourth switching state.
Figure 15:
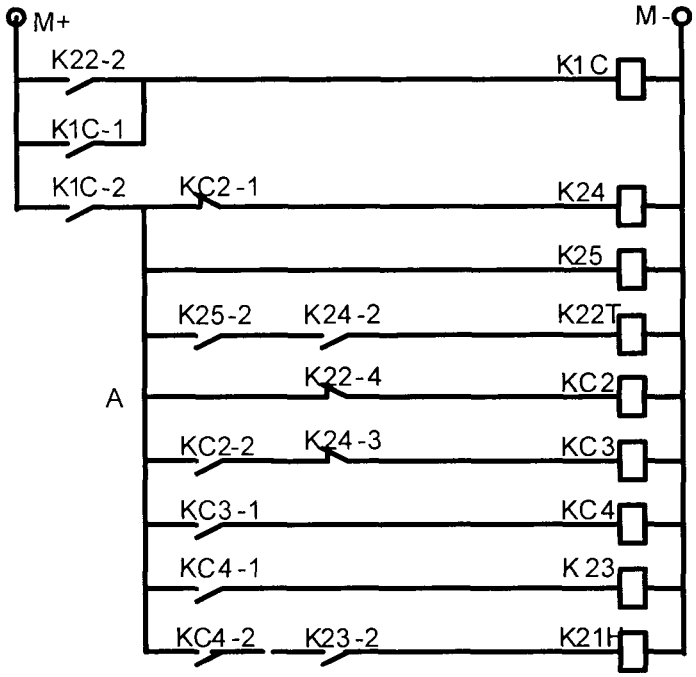

The control circuit of the switcher 11 for switching the conduction of the terminal J1 of the fourth thyristor assisted on-load tap changer implemented by a contactor (relay) with the common terminal J3 to the conduction of the terminal J2 with the common terminal J3 is as shown in FIG. 15 (*a*).

M+ refers to a positive bus of a control power supply, and M− refers to a negative bus of the control power supply; K21T refers to the breaking (unlocking) coil of a K21 contactor, K21-1 refers to the main contact of the K21 contactor, and K21-2 refers to the auxiliary contact of the K21 contactor; K22H refers to the closing coil of a K22 contactor, K22-1 refers to the main contact of the K22 contactor, and K22-2 refers to the auxiliary contact of the K22 contactor. K23-1, K23-2, K23-3 refer to the contacts of a relay K23, K24-1, K24-2 refer to the contacts of a relay K24, K26-1, K26-2 refer to the contacts of a relay K26, K1C-1, K1C-2 refer to the contacts of a relay K1C, KC2-1, KC2-2 refer to the contacts of a relay KC2, KC3-1 refers to the contact of a relay KC3, and KC4-1, KC4-2, KC4-3 refer to the contacts of a relay KC4.

A normally open contact K21-2 and a relay coil K1C are serially connected between the buses M+ and M−; the two ends of the normally open contact K21-2 are also connected with the normally open contact K1C-1 in parallel. A normally open contact K1C-2 is connected between a collection line A and the bus M+. A normally closed contact KC2-1 and a relay coil K23 are serially connected between the collection line A and the bus M−. A relay coil K26 is serially connected between the collection line A and the bus M−. A normally open contact K26-2, a normally open contact K23-2 and the contactor breaking coil K21T are serially connected between the collection line A and the bus M−. A normally closed contact K21-4 and a relay coil KC2 are serially connected between the collection line A and the bus M−. A normally open contact KC2-2, a normally closed contact K23-3 and a relay coil KC3 are serially connected between the collection line A and the bus M−. A normally open contact KC3-1 and a relay coil KC4 are serially connected between the collection line A and the bus M−. A normally open contact KC4-1 and a relay coil K24 are serially connected between the collection line A and the bus M−. A normally open contact KC4-2, a normally open contact K24-2 and the contactor closing coil K22H are serially connected between the collection line A and the bus M−.

The working process thereof is as follows: the buses M+ and M− are connected with the power supply. The contact K21-2 is switched on, the relay K1C acts, the contact K1C-1 is switched on, and the relay K1C self holds. The contact K1C-2 is switched on. The contact KC2-1 is switched on, the relay K23 acts, the contact K23-1 in FIG. 12 is switched on, and the thyristor assisted circuit I8 is connected to serve as a switch. The relay K26 acts, the contact K26-1 in FIG. 12 is switched on, the thyristor assisted circuit II9 is switched on to serve as the overvoltage triggering thyristor circuit, and the overvoltage triggering thyristor circuit is not conducted. The contact K26-2 is switched on, the contact K23-2 is switched on, the contactor breaking coil K21T is energized, and the main contact K21-1 of the contactor in FIG. 12 is switched off. The contact K21-4 is switched on, and the relay KC2 acts. The contact KC2-1 is switched off, the relay K23 returns, the contact K23-1 in FIG. 12 is switched off, and the thyristor assisted circuit I8 cuts off the current path at the zero crossing point of the current. At the moment when the thyristor assisted circuit I8 cuts off the current path at the zero crossing point of the current, the thyristor assisted circuit II9 is connected to serve as the overvoltage triggering thyristor circuit. The contact KC2-2 is switched on, the contact K23-3 is switched on, and the relay KC3 acts. The contact KC3-1 is switched on, and the relay KC4 acts. The contact KC4-1 is switched on, the relay K24 acts, the contact K24-1 of the thyristor assisted circuit II9 in FIG. 12 is switched on, and the thyristor assisted circuit II9 is used as a switch to conduct the current path. Since the action times of the relays KC3, KC4, K24 are about 15 milliseconds, it can be ensured that the contact KC4-1 is switched on more than 20 milliseconds after the contact K23-1 is switched off, thus generating no short circuit circulation. The contact KC4-2 is switched on, the contact K24-2 is switched on, and the contactor closing coil K22H is energized; the main contact K22-1 in FIG. 12 is switched on, and the load current is transferred to the path of J3 and J2. Similarly, it can be designed that: the switcher control circuit for switching the conduction of the terminal J2 of the fourth thyristor assisted on-load tap changer with the common terminal J3 to the conduction of the terminal J1 with the common terminal J3 is as shown in FIG. 15 (*b*). The working principle of FIG. 15 (*b*) is similar to that of FIG. 15 (*a*), and will not be repeated redundantly.

EMBODIMENT 8

The operating power supply of a switcher 11 of an on-load tap-changer is generally from a local 220V low-voltage power supply. If a regulating transformer is connected in a Y shape, a transformer tap is close to a ground wire, and the voltage of the transformer tap is lower; the voltage between the contacts of switches K21-1, K22-1, K23-1, K24-1, K25-1, K26-1 and the operating power supply is lower. If the coils of the regulating transformer are connected in a triangle, the voltages of the contacts of the switches K21-1, K22-1, K23-1, K24-1, K25-1, K26-1 are high, the voltage between the contacts of the switches K21-1, K22-1, K23-1, K24-1, K25-1, K26-1 and the operating power supply is higher, the contacts of the switches K21-1, K22-1, K23-1, K24-1, K25-1, K26-1 and the operating power supply must be well insulated, and a high-voltage insulating material is expensive.

Figure 16:
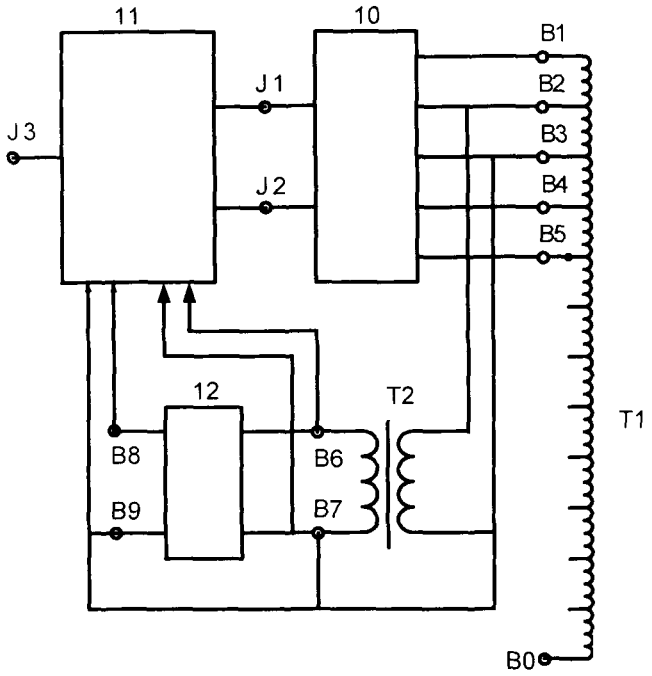
FIG. 16 shows a power supply structure of a thyristor assisted on-load tap changer.

This embodiment provides a power supply structure of a thyristor assisted on-load tap changer with lower insulating requirements between the contacts of the switches K21-1, K22-1, K23-1, K24-1, K25-1, K26-1 and the operating power supply. For convenience of expression, the structure and the connecting manner of a thyristor assisted on-load tap changer with five tap terminals are as shown in FIG. 16. It is assumed that, the regulating transformer T1 has five tap terminals, which are respectively connected to the input terminals B1, B2, B3, B4, B5 of a tap selector 10 of the thyristor assisted on-load tap changer; the output terminal of the tap selector 10 is connected with the input terminals J1, J2 of the switcher; a common terminal J3 of the switcher 11 is connected with a power system.

In the tap terminals B1, B2, B3, B4, B5 of the regulating transformer, the centremost terminal (B3) is defined as a null line and is connected with one terminal of a primary coil of a transformer T2; the tap terminal B2 (or B4) of the regulating transformer adjacent to the null line is connected with another terminal of the primary coil of the transformer T2. Terminals B6, B7 of a secondary coil of the transformer T2 provide an AC control voltage (for example, AC 220V) to the switcher 11 of the thyristor assisted on-load tap changer; one terminal of the AC control voltage is defined as a null line, and the null line of the primary coil of the transformer T2 is connected with the null line of the secondary coil of the transformer T2.

An AC control voltage terminal is used as the input to a DC voltage stabilization power supply module 12, the DC voltage stabilization power supply module 12 outputs a DC voltage (for example, B8, B9 DC 24V) or multiple DC voltages. The output of the DC voltage stabilization power supply module 12 provides a DC control voltage to the switcher 11 of the thyristor assisted on-load tap changer; the low-potential terminal of the DC control voltage is defined as a null line, and the null line of the DC control voltage is connected with the null line of the AC control voltage.

The power supply of the switcher 11 of the original on-load tap changer is from the local low-voltage power supply, and the zero potential of the local low-voltage power supply is equal to the ground potential. If the switcher 11 of the on-load tap changer in the present invention is controlled in the manner of a contactor, the ground voltage of the contact of the switcher 11 is equal to the ground voltage of a certain terminal in the terminals B1, B2, B3, B4, B5, and the terminals B1, B2, B3, B4, B5 have high voltages; the coil of the contactor is connected with a control power supply, the potential difference between the contact and the coil is very high, thus an expensive high-voltage contactor is needed.

In this embodiment, the power supply of the switcher 11 of the thyristor assisted on-load tap changer is from the transformer T2, the transformer T2 only provides power supply to the thyristor assisted on-load tap changer, the capacity is small, thus the transformer is a small capacity transformer. The null line of the power supply has the same potential as B3, the maximum potential difference between the contact and the coil is equal to the potential difference between B1 and B3. The requirements on the insulating withstand voltage between the contactor coil and the switch contact are reduced, thus the manufacturing cost can be reduced; in particular, for the on-load tap changer of a 10 kV system, the potential difference between B1 and B3 is 5% of 10 kV, namely AC 500 V. The switcher 11 of the thyristor assisted on-load tap changer can be manufactured by a conventional AC contactor to reduce the manufacturing cost.

The potential of the null line is equal to the potential of the centremost terminal among B1, B2, B3, B4, B5, and the potential is very high; therefore, the withstand voltage between the null line and the ground is larger than the maximum normal voltage between the terminals B1 and B0 of the regulating transformer, in order to avoid insulation breakdown between the null line and the ground.

If the tap selector 10 of the thyristor assisted on-load tap changer is also implemented in the manner of a contactor (relay), the structure of the operating power supply of the tap selector 10 of the on-load tap changer is the structure as shown in FIG. 16. The analysis method is the same as the above and will not be repeated redundantly.

EMBODIMENT 9

The action time of an on-load tap changer of a power system is very short, and the on-load tap changer is at a non-action state at most of time. Within the non-action time period of the on-load tap changer, if the two ends of a thyristor assisted circuit have voltages, the safety is poor; if the two ends of the thyristor assisted circuit have no voltage, the safety is high. The structure of the switcher of the fourth thyristor assisted on-load tap changer as shown in FIG. 12 is suitable for the use that only one tap of the terminal J1 and the terminal J2 of the switcher is connected with the transformer during normal operation. For example, the conduction of the terminal J1 of the switcher of the on-load tap changer with a common terminal J3 is switched to the conduction of the terminal J2 with the common terminal J3. After the switching of the switcher is finished, the tap selector disconnects the connection of J1 with the transformer. At this time, the voltages at the two ends of the economical thyristor assisted circuit I8 and the economical thyristor assisted circuit II9 are zero, thus the safety is good.

Figure 14:
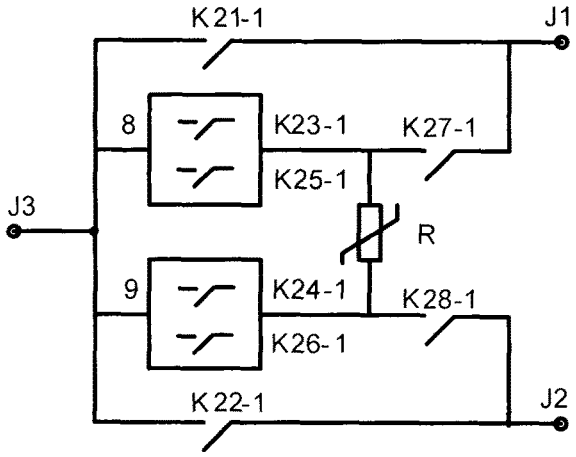
FIG. 14 shows a structure of a switcher of a fifth thyristor assisted on-load tap changer.

During normal operation, if the terminal J1 and the terminal J2 of the switcher are still connected with the transformer and are not disconnected, the structure of the switcher of the fifth thyristor assisted on-load tap changer can be selected, the switcher includes a main switch K21-1, a main switch K22-1, a switch K27-1, a switch K28-1, a thyristor assisted circuit I, a thyristor assisted circuit II, a piezoresistor R and three terminals J1, J2, J3; one end of the main switch K21-1 is connected with the terminal J1, and the other end of the main switch K21-1 is connected with the terminal J3; one end of the thyristor assisted circuit I is connected with the terminal J3, and the other end of the thyristor assisted circuit I is connected with the terminal J1 through the switch K27-1; one end of the main switch K22-1 is connected with the terminal J2, and the other end of the main switch K22-1 is connected with the terminal J3; one end of the thyristor assisted circuit II is connected with the terminal J3, and the other end of the thyristor assisted circuit II is connected with the terminal J2 through the switch K28-1; the end of the thyristor assisted circuit I connected with the switch K27-1 and the end of the thyristor assisted circuit II connected with the switch K28-1 are further connected with the piezoresistor R, as shown in FIG. 14.

Within the non-action time period of the on-load tap changer, K27-1 and K28-1 are switched off, the voltages at the two ends of the economical thyristor assisted circuit I8 and the economical thyristor assisted circuit II9 are zero. Before the switcher of the on-load tap changer works, K27-1 and K28-1 are switched on. After the switcher of the on-load tap changer works, K27-1 and K28-1 are switched off immediately. The actions of the switch contacts K27-1 and K28-1 can be achieved by an AC contactor. When the coil of an AC contactor K27 is energized, the contact K27-1 of the AC contactor K27 acts, and when the coil of an AC contactor K28 is energized, the contact K28-1 of the AC contactor K28 acts. Before the switcher of the thyristor assisted on-load tap changer works, the coils of the AC contactors K27 and K28 are firstly energized, and then the operation program of the switcher is entered. After the thyristor assisted on-load tap changer finishes the work, the coils of the AC contactors K27 and K28 are de-energized.

The rest structure and program of the fifth thyristor assisted on-load tap changer are the same as those in embodiment 6 and will not be repeated redundantly.

The thyristor assisted on-load tap changer and the method thereof in the present invention can be designed and manufactured by the prior art and can be completely achieved, thereby having a broad application prospect.

The invention claimed is:

1. A thyristor assisted on-load tap changer, comprising a tap selector and a switcher, wherein the tap selector is connected with the switcher, and after the tap selector selects a tap from tap terminals of a regulating transformer, the switcher completes an on-load switch of the tap; wherein, the switcher comprises a first main switch, a second main switch, a first thyristor assisted circuit, a second thyristor assisted circuit, a piezoresistor, a first terminal, a second terminal and a third terminal;

one end of the first main switch is connected with the first terminal, and the other end of the first main switch is connected with the third terminal, the first thyristor assisted circuit is connected with the first main switch in parallel;

one end of the second main switch is connected with the second terminal, and the other end of the second main switch is connected with the third terminal, the second thyristor assisted circuit is connected with the second main switch in parallel;

the end of the first thyristor assisted circuit next to the first terminal and the end of the second thyristor assisted circuit next to the second terminal are further connected with the piezoresistor;

a pair of switches are respectively arranged in the first thyristor assisted circuit and the second thyristor assisted circuit, for controlling a state switch of the corresponding thyristor assisted circuit, wherein the first thyristor assisted circuit has a first normally open switch and a second normally open switch;

the second thyristor assisted circuit has a third normally open switch and a fourth normally open switch.

2. The thyristor assisted on-load tap changer of claim 1, wherein the first thyristor assisted circuit and the second thyristor assisted circuit have the same structure and respectively comprise:

a pair of thyristors that are reversely connected in parallel to form a main path of the thyristor assisted circuit;

a resistor and a capacitor that are connected to the ends of the two thyristors that are reversely connected in parallel after being connected in series;

wherein gate electrodes and cathodes of the two thyristors are respectively connected with capacitors resistors and diodes; anodes of the diodes are respectively connected with the gate electrodes of the two thyristors, and cathodes of the diodes are respectively connected with the cathodes of the two thyristors;

an input terminal of a full-bridge rectifier composed of four diodes is connected between the gate electrodes of the two thyristors after being serially connected with the first normally open switch, an output end of the full-bridge rectifier is connected with a constant voltage diode, a cathode of the constant voltage diode is connected with an anode output end of the full-bridge rectifier, and an anode of the constant voltage diode is connected with a cathode output end of the full-bridge rectifier;

a first diode string of three diodes are serially connected in a first same direction, a second diode string of three diodes are serially connected in a second same direction, and the two diode strings are serially connected with the second normally open switch after being reversely connected in parallel and are connected between the gate electrodes of the two thyristors.

3. The thyristor assisted on-load tap changer of claim 1, wherein in the tap terminals of the regulating transformer, the centremost tap terminal is defined as a null line, the null line and an adjacent tap terminal of the regulating transformer are respectively connected with two terminals of a primary coil of a transformer, and a terminal of a secondary coil of the transformer provides an AC control voltage to the switcher; one terminal of the AC control voltage is defined as a null line, and the null line of the primary coil of the transformer is connected with the null line of the secondary coil of the transformer;

an AC control voltage terminal is further used as an input to a DC voltage stabilization power supply module, the DC voltage stabilization power supply module provides a DC control voltage to the switcher, a low-potential terminal of the DC control voltage is defined as a null line, and the null line of the DC control voltage is connected with the null line of the AC control voltage.

4. A working method of the thyristor assisted on-load tap changer of claim 1, comprising:

a. a working method of switching conduction of the first terminal of the switcher with the third terminal as a common terminal to conduction of the second terminal with the third terminal as a common terminal, including operations in the following order:

(1) switching on the first normally open switch and switching on the fourth normally open switching; (2) switching off the first main switch; (3) switching off the first normally open switch K23-1; (4) switching on the second normally open switch; (5) switching on the second main switch; (6) resetting the entire group;

b. a working method of switching conduction of the second terminal of the switcher of the on-load tap changer with the third terminal as a common terminal to conduction of the first terminal with the third terminal as a common terminal, including operations in the following order:

(1) switching on the third normally open switch and switching on the second normally open switch; (2) switching off the second main switch; (3) switching off the third normally open switch; (4) switching on the first normally open switch; (5) switching on the first main switch; (6) resetting the entire group.

5. The working method of claim 4, wherein when switching the conduction of the first terminal of the switcher of the on-load tap changer with the third terminal as a common terminal to the conduction of the second terminal with the third terminal as a common terminal, a time interval between switching off the first normally open switch and switching on the third normally open switch is larger than 20 milliseconds;

when switching the conduction of the second terminal of the switcher of the on-load tap changer with the third terminal as a common terminal, to the conduction of the first terminal with the third terminal as a common terminal, a time interval between switching off the third normally open switch and switching on the first normally open switch is larger than 20 milliseconds.

6. A thyristor assisted on-load tap changer, comprising a tap selector and a switcher, wherein the tap selector is connected with the switcher, and after the tap selector selects a tap of a regulating transformer, the switcher completes an on-load switch of the tap; wherein, the switcher comprises a first main switch, a second main switch, a first switch, a second switch, a first thyristor assisted circuit, a second thyristor assisted circuit, a piezoresistor, a first terminal, a second terminal and a third terminal;

one end of the first main switch is connected with the first terminal, the other end of the first main switch is connected with the third terminal; one end of the first thyristor assisted circuit is connected with the third terminal, and the other end of the first thyristor assisted circuit is connected with the second terminal through the first switch;

one end of the second main is connected with the second terminal, and the other end of the second main switch is connected with the third terminal; one end of the second thyristor assisted circuit is connected with the third terminal, and the other end of the second thyristor assisted circuit is connected with the second terminal through the second switch, the end of the first thyristor assisted circuit connected with the first switch and the end of the second thyristor assisted circuit connected with the second switch are further connected with the piezoresistor;

a pair of switches are respectively arranged in the first thyristor assisted circuit and the second thyristor assisted circuit, for controlling a state switch of the corresponding thyristor assisted circuit, wherein the first thyristor assisted circuit has a first normally open switch and a second normally open switch;

the second thyristor assisted circuit has a third normally open switch and a fourth normally open switch.

* * * * *